US007342549B2

(12) United States Patent
Anderson

(10) Patent No.: US 7,342,549 B2
(45) Date of Patent: Mar. 11, 2008

(54) CONFIGURABLE ARRAYS FOR STEERABLE ANTENNAS AND WIRELESS NETWORK INCORPORATING THE STEERABLE ANTENNAS

(76) Inventor: Theodore R. Anderson, 7 Martin Rd., Brookfield, MA (US) 01506

( * ) Notice: Subject to any disclaimer, the term of this patent is extended or adjusted under 35 U.S.C. 154(b) by 76 days.

(21) Appl. No.: 11/024,254

(22) Filed: Dec. 28, 2004

(65) Prior Publication Data

US 2005/0110691 A1 May 26, 2005

Related U.S. Application Data

(63) Continuation of application No. 10/648,878, filed on Aug. 27, 2003, now Pat. No. 6,870,517.

(51) Int. Cl.
*H01Q 13/10* (2006.01)

(52) U.S. Cl. ..... 343/770; 343/701

(58) Field of Classification Search ..... 343/770, 343/701, 742, 702, 909
See application file for complete search history.

(56) References Cited

U.S. PATENT DOCUMENTS 3,914,766 A * 10/1975 Moore ..... 343/701
5,594,456 A * 1/1997 Norris et al. ..... 343/701
5,963,169 A 10/1999 Anderson et al.
6,046,705 A 4/2000 Anderson
6,087,992 A 7/2000 Anderson
6,118,407 A 9/2000 Anderson
6,169,520 B1 * 1/2001 Anderson ..... 343/701
6,369,763 B1 * 4/2002 Norris et al. ..... 343/701
2003/0142021 A1 7/2003 Anderson
2003/0146879 A1 * 8/2003 Anderson ..... 343/742

* cited by examiner

*Primary Examiner*—Huedung Mancuso
(74) *Attorney, Agent, or Firm*—Notaro & Michalos P.C.

(57) ABSTRACT

An reconfigurable array of variable conductive elements is provided for reflecting, filtering and steering electromagnetic radiation across a wide range of frequencies. The reconfigurable array is combined with a transmitting antenna to make a steerable antenna. The reconfigurable array surrounds the transmitting antenna and reflects all transmissions except on selected radials where apertures in the reconfigurable array are formed for permitting transmission lobes. The reconfigurable arrays can be arranged in stacked layers to make transceiving multiband antennas. Communications networks using the steerable antennas and arrays are also disclosed.

11 Claims, 19 Drawing Sheets

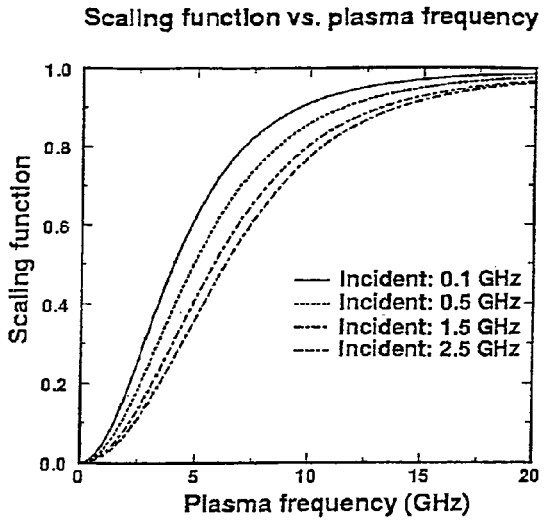
FIG. 1B
FIG. 1C
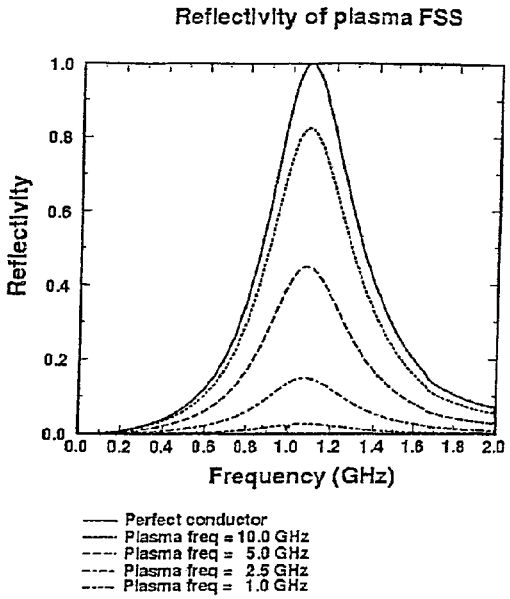
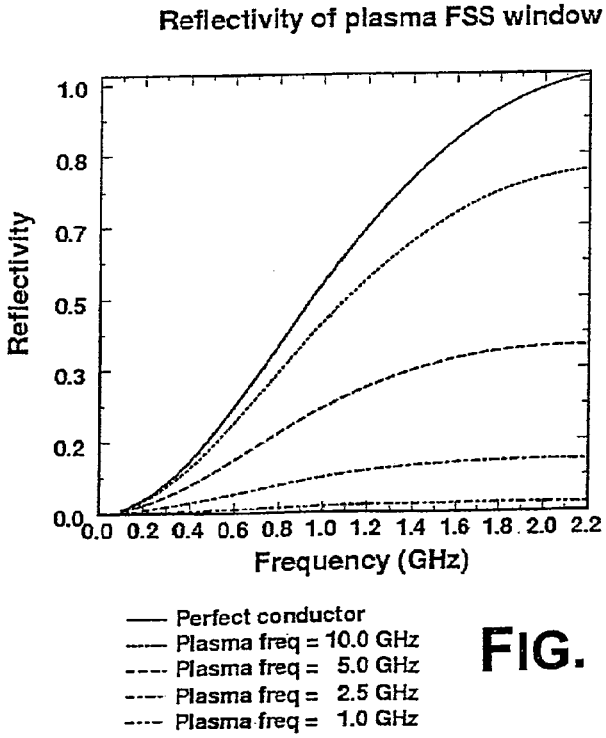
FIG. 1D

CONFIGURABLE ARRAYS FOR STEERABLE ANTENNAS AND WIRELESS NETWORK INCORPORATING THE STEERABLE ANTENNAS

CROSS REFERENCE TO RELATED APPLICATION

This is a continuation of application Ser. No. 10/648,878 file Aug. 27, 2003, incorporated here by reference and now U.S. Pat. No. 6,870,517.

FIELD AND BACKGROUND OF THE INVENTION

The present invention relates generally to the field of antennas and in particular to a new and useful directional antenna that is steerable by configuring a switched plasma, semiconductor or optical crystal screen surrounding a central transmitting antenna.

Traditionally, antennas have been defined as metallic devices for radiating or receiving radio waves. Therefore, the paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature.

Included among these antennas are omnidirectional antennas, which radiate electromagnetic frequencies uncontrolled in multiple directions at once, such as for use broadcasting communications signals. Usually, in the absence of any additional attennas or signal attenuators, an omnidirectional radiation lobe resembles a donut centered about the antenna. Antenna arrays are known for producing a directed transmission lobe to provide more secure transmissions than omnidirectional antennas can. Known antenna arrays require many powered antennas all sized appropriately to interfere on particular frequencies with the main transmitting antenna radiation lobe, and thereby permit transmission only in the preferred direction. Antenna arrays normally have a significant footprint, which increases greatly as the angular width of the transmission lobe is reduced.

Generally, an antenna is a conducting wire which is sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half, and full wavelengths of the desired frequency.

Plasma antennas are a newer type of antenna which produce the same general effect as a metal conducting wire. Plasma antennas generally comprise a chamber in which a gas is ionized to form plasma. The plasma radiates at a frequency dictated by characteristics of the chamber and excitation energy, among other elements. U.S. Pat. No. 6,369,763 and applicant's co-pending application Ser. No. 10/067,715 filed Feb. 5, 2002 disclose different configurations and applications for plasma antennas.

Efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. The antenna will then resonate with RF radiation at some multiple of the length of the antenna. Due to this, metal antennas are somewhat limited in breadth as to the frequency bands that they may radiate or receive.

Recently, wireless communications have become more and more important, as wireless telephones and wireless computer communication are desired by more people for new devices. Current wireless communications are limited to particular ranges of the electromagnetic frequency spectrum. High-speed communications are limited by the selected frequency spectrum and number of users which must be accommodated. For example, 3G networks can presently provide a maximum data transfer rate of up to 2 Mbps, shared among network users.

Also, because most non-line-of-sight wireless communications are now done using omnidirectional antennas, transmissions between wireless communicators may be easily intercepted by an unintended recipient having the correct equipment. Transmissions require data encryption to provide some security, which detracts from computing speed and can increase the amount of data transmitted.

In the case of wireless home networking, for example, it is simple for an unauthorized user to connect via a compatible wireless device due to the omnidirectional nature of the antennas used to transmit and receive the network communications between devices. The unauthorized user can simply situate themselves within the effective distance of the wireless network transceiver, and they can use the omnidirectional transmission lobe to gain access to the wireless network. This inability to limit access by the shape of the area within the wireless network inherent in known wireless networks is one reason for slow acceptance of wireless networks in offices and other work environments where communications security is needed.

Further, because omnidirectional antennas broadcast indiscriminately, an unauthorized user can find an available wireless network to piggy-back on, or worse, break into, using basic signal detection equipment. Antennas can be provided in arrays to limit the radial direction in which an active antenna broadcasts. Arrays rely upon the reflective and absorptive properties of antennas to produce transmission lobes in specific radial directions. Increasingly more antennas are required to produce increasingly narrower lobes and no or smaller side lobes. Larger arrays with more antennas necessarily require more space to work effectively, and therefore have a larger footprint than a single omnidirectional antenna or a small array. Thus, conventional antenna arrays are not practical for home and office wireless communications applications due to their large size requirements for effectively directing the radiation lobes of the broadcasting antenna.

As a result, directional antenna arrays are normally only used in military applications. But, even military applications are limited by the size requirements for direction antenna arrays. While it is relatively simply to install an array on an aircraft carrier, it is essentially impossible to install an effective array on a Humvee or fighter jet, for example. And, changing the transmission lobe direction with an array requires switching antennas in the array between powered and unpowered states. Metal antennas experience a delay during switching, so that changing the transmission lobe direction in an array is not instantaneous.

Therefore, there is clearly a both a civilian and military need for a directional antenna which occupies a relatively small space, can be mobile, and is rapidly configurable to produce a transmission lobe in any direction upon command.

Further, expansion of wireless networking capabilities is needed, as wireless communications become more and more ingrained in daily life.

SUMMARY OF THE INVENTION

It is an object of the present invention to provide a directional antenna requiring less elements and having a smaller size footprint than arrays.

Another object of the invention is to provide a directional antenna which is steerable.

A further object of the invention is to provide a directional antenna with radiation lobes steerable in two axes.

It is a still further object of the invention to provide a wireless local area communications network using a steerable directional antenna.

A still further object of the invention is to provide the basis for steerable antennas which function over a range of frequencies including microwave (kHz) to millimeter range (Ghz), TeraHertz, infrared, and optical ranges.

Yet another object of the invention is to provide a wireless networking system with increased data transfer capacity between users.

Accordingly, a steerable antenna is provided comprising an omnidirectional antenna surrounded by a concentric annular switchable electromagnetic shield of variably conductive elements for controllably opening a transmission window at a selected radial angle. The shield may also include switchable variable conductive elements for controlling an elevation angle of the transmission lobe passing through the window, so that the antenna is steerable on two axes.

The electromagnetic shield is formed by a hollow cylinder of switchable conductive elements. In one embodiment, the shield is a ring of plasma tubes extending parallel with the omnidirectional antenna, a ring of photonic bandgap crystal elements or semiconductor elements. The omnidirectional antenna can be a conventional antenna, a plasma antenna or an optical wavelength transmitter. The transmission window is formed by either turning off power to the appropriate electromagnetic shield elements, or otherwise making the desired shield elements transparent to the transmitting antenna. The shield elements are preferably rapidly switchable, so that the radial transmission direction of the antenna can be changed instantaneously. The shield elements are selected for use with antennas broadcasting on a broad range of frequencies including microwave to millimeter range (kHz to GHz), TeraHertz, infrared and optical ranges.

An alternate embodiment of the shield utilizes a cylindrical array of switchable variable conductive elements to provide more selective control over where openings in the shield are formed. The cylindrical shield with the array surrounds an antenna. The elements forming the array are arranged in multiple rows and columns on a substrate. The substrate can be a planar sheet rolled into a cylinder shape. The variable conductive elements can be either switchable regions surrounding fixed air gaps or slots, so that the effective size of the fixed slots can be changed rapidly, or the elements can be formed as linear conductors, rectangles, stars, crosses or other geometric shapes of plasma tubes, photonic bandgap crystals or solid state semiconductors on the substrate.

A more complex shield for the antenna has one or more stacked layers, with each layer being a cylindrical switchable array of shield elements. The layers are spaced within one wavelength of adjacent layers to ensure proper function. Each switchable array in the stack can be a filter, a polarizer or a phase shifter. The layers are combined to produce a particular effect, such as producing a steerable antenna transmitting only polarized signals in specific frequency bands.

In one application of the steerable antenna, a relatively secure home or office wireless network is provided having a steerable antenna of the invention connected to a server computer for wireless communications with workstations. Transmission windows for radiation lobes are formed in the electromagnetic shield surrounding the server steerable antenna for each surrounding radial on which a workstation is present. Individual workstations may have omnidirectional antennas for receiving data from and transmitting back to the server antenna, or they may also have steerable antennas of the invention.

In a further embodiment of the invention, steerable antennas are used to provide secure communications between devices when one or both are moving. Mobile units of a communications network are wirelessly connected using steerable antennas. A central unit can be stationary or mobile and has a steerable antenna broadcasting through one or more transmission windows in the electromagnetic shield. One or more mobile satellite units have antennas which can be omnidirectional or steerable. The satellite units and central unit have circuits for determining when a connection is made with each other and maintaining the connection while they move relative to each other. Initially, satellite units with steerable antennas operate the antennas as an omnidirectional antenna. Once a connection is made, the electromagnetic shield of the satellite unit steerable antenna is activated to produce only a transmission window and radiation lobe along the radial axis needed to maintain the connection with the central unit. The steerable antenna shield on the central and each connected satellite unit is adjusted to compensate for their relative movement while maintaining the connections.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1B is a graph plotting scaling function values versus plasma frequency for the array of FIG. 1A;

FIG. 1C is a graph plotting reflectivity versus frequency for a plasma FSS;

FIG. 1D is a graph plotting reflectivity versus frequency for a plasma FSS window;

DESCRIPTION OF THE PREFERRED EMBODIMENTS

Figure 1A:
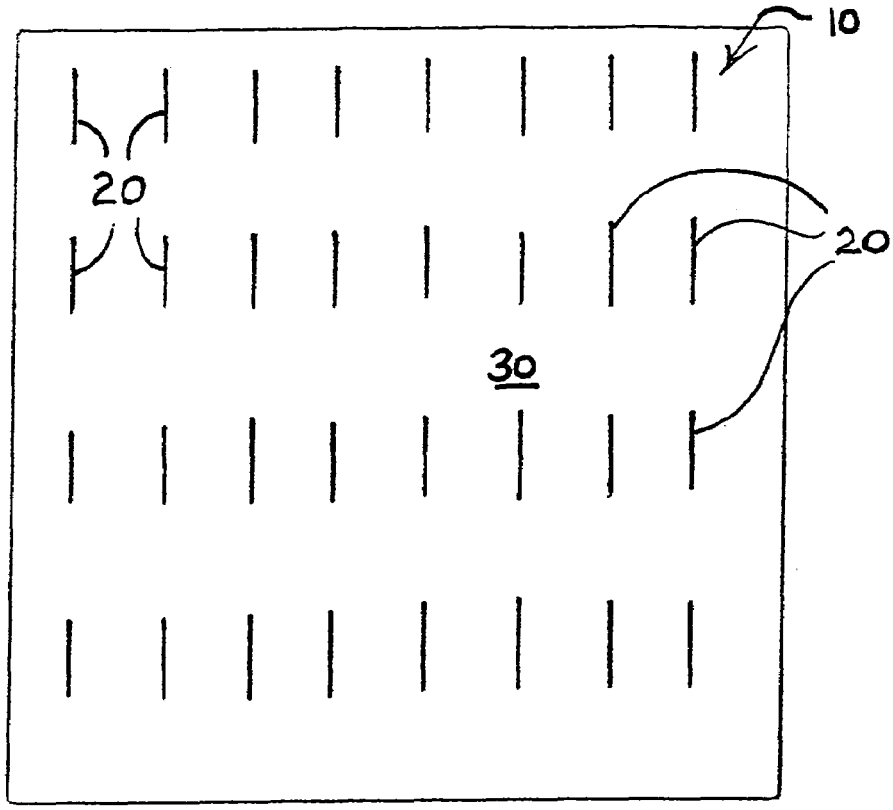
FIG. 1A is a schematic representation of a planar array of variable conductive elements on a dielectric surface in a non-conducting state.

Referring now to the drawings, in which like reference numerals are used to refer to the same or similar elements, FIG. 1A shows an array 10 of linear variable conductive elements 20 on a dielectric surface 30. The array 10 of FIG. 1A represents the foundation of the steerable antennas described herein. The array is configurable, by energizing all, none or specific ones of the elements 20, to filter selected frequencies of electromagnetic radiation, including in the optical range. It should be noted that elements 20 are dipoles. Feeds (not shown) are provided to each element 20 in the array 10 using connectors which are electrically small with respect to the dipole and relevant frequencies.

Depending on the frequency range desired to be affected by the array 10, the variable conductive elements 20 are formed by different structures. In the RF frequency range, the variable conductive elements 20 are a gaseous plasma-containing element, such as a plasma tube. In the millimeter infrared or optical region, the variable conductive elements 20 can be dense gaseous plasma-containing elements or semiconductor elements. And, in the optical region, the elements are photonic bandgap crystals. The variable conductive elements 20 are referred to herein primarily as gaseous plasma-containing elements or plasma tubes, but, unless specifically stated otherwise, are intended to alternately include semiconductor elements or photonic bandgap crystals, depending on the desired affected frequency of the incident electromagnetic waves. And, as used herein, plasma tube or plasma element is intended to mean an enclosed chamber of any shape containing an ionizable gas for forming a plasma having electrodes for applying an ionizing voltage and current.

Figure 2:
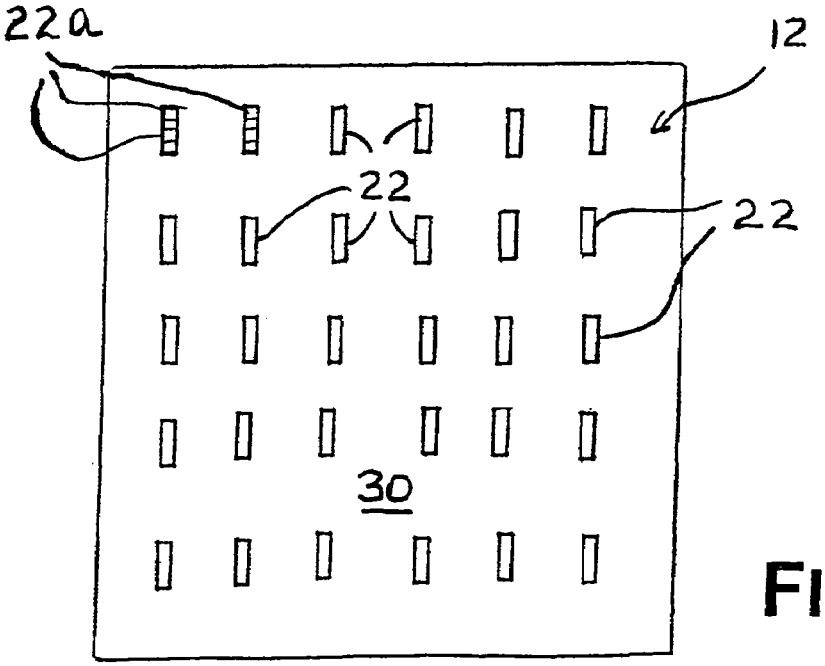
FIG. 2 is a schematic representation of a planar array of slot elements on a dielectric surface in a non-conducting state.

FIG. 2 illustrates an alternate embodiment of the array 10 of FIG. 1A. In FIG. 2, a second array 12 has slot elements 22 on a dielectric substrate 30. Slot elements 22 may also be plasma elements, photonic bandgap crystals or semiconductor elements, depending on the filtered frequencies.

The arrays 10, 12 of the invention use plasma elements 20, 22 as a substitute for metal, as depicted in FIGS. 1A and 2. When metal is used instead for the elements 20, 22 each layer has to be modeled using numerical methods and the layers are stacked in such a way to create the desired filtering. Genetic algorithms are used to determine the stacking needed for the desired filtering. This is a complicated and numerically expensive process.

In contrast, arrays 10, 12 can be tuned to a desired filtering frequency by varying the density in the plasma elements. This eliminates much of the routine analysis involved in the standard analysis of conventional structures. The user simply tunes the plasma to get the filtering desired. Plasma elements 20, 22 offer the possibility of improved shielding along with reconfigurability and stealth. The array 10 of FIG. 1A, for example, can be made transparent by simply turning the plasma off.

As the density of the plasma in a plasma element 20 is increased, the plasma skin depth becomes smaller and smaller until the elements 20, 22 behave as metallic elements and the elements 20, 22 create filtering similar to a layer with metallic elements. The spacing between adjacent elements 20, 22 should be within one wavelength of the frequency desired to be affected to ensure the elements 20, 22 will function as an array. The basic mathematical model for these arrays 10, 12 models the plasma elements 20, 22 as half wavelength and full wavelength dipole elements in a periodic array 10, 12 on a dielectric substrate 30. Theoretically, Flouquet's Theorem is used to connect the elements. Transmission and reflection characteristics of the arrays 10, 12 of FIGS. 1A and 2 are a function of plasma density. Frequencies from around 900 MHz to 12 GHz with a plasma density around 2 GHz are used are used in the theoretical calculations.

The following discussion will explain the operation of the array 10, 12. First, in the array 10, 12 of FIG. 1A or 2, a scattering element 20, 22 is assumed to consist of gaseous plasma contained in a tube. The following explanation will demonstrate the electromagnetic scattering properties of the array 10, 12 as a function of the reflectivity of the plasma elements 20, 22. It should be noted that the plasma elements 20, 22 may be divided along their lengths into segments for the purpose of defining current modes, as will be discussed below.

Method of Calculation

The response (reflection and transmission) of the array 10, 12 FIG. 1A or 2 is calculated in two stages. First, the response for a perfectly conducting structure is calculated. Then, the reflectivity is scaled by a function that depends on the incident frequency and the plasma frequency so as to account for the scattering properties of the plasma.

Periodic Moment Method

In the first stage of calculation, we use the Periodic Moment Method. See, e.g., B. A. Munk, "Frequency Selective Surfaces," (Wiley Interscience 2000). The elements 20, 22 are approximated as thin, flat wires. The scattered electric field produced by an incident plane wave of a single frequency is given by:

$$\overline{E}(\overline{R}) = -I_A \frac{Z}{2D_xD_y}\sum_{k=-\infty}^{\infty}\sum_{n=-\infty}^{\infty}\frac{e^{-j\beta\overline{R}_L r_\pm}}{r_y}$$

$$[({}_\perp\hat{n}_\pm)({}_\perp P) + ({}_\parallel\hat{n}_\pm)({}_\parallel P)].$$

The quantities in this equation are defined as follows. The quantity $I_A$ is the current induced in a single element by the incident plane wave, Z is the impedance of the medium which we take to be free space (Z=377 Ω), $\overline{R}$ is the position vector of the observation point, and the scattering vector is defined by:

$$\hat{r}_\pm = x\hat{r}_x \pm y\hat{r}_y + z\hat{r}_z$$

with, $$r_x = s_x + k\frac{\lambda}{D_x}$$

and, $$r_z = s_z + n\frac{\lambda}{D_z}$$

and, $$r_y = \sqrt{1-\left(s_x + k\frac{\lambda}{D_x}\right)^2 - \left(s_z + n\frac{\lambda}{D_z}\right)^2}$$

In these equations, $s_x$, and $s_z$, are the components of the unit vector specifying direction of the incident plane wave. It is assumed that the array 10, 12 lies in the x-z plane with repeat distances $D_x$, and $D_z$, and the directions $\pm\hat{y}$ indicate the forward and back scattering directions respectively. Note that for sufficiently high values of the integers, n and k, the scattering vector component $r_y$ becomes imaginary corresponding to evanescent modes.

The remaining quantities, enclosed in the square brackets of the expression for the scattered field, are related to the way in which the incident electric field generates a voltage in an array element. The voltage induced in a scattering element by the incident field is given by:

$$V(\overline{R}) = \overline{E}(\overline{R}) \square \hat{p} P,$$

where, $\overline{E}(\overline{R})$ is the electric field vector of the incident plane wave, $\hat{p}$ is a unit vector describing the orientation of the scattering element, and P is the pattern function for the scattering element and is defined by:

$$P = \frac{1}{I^t(\overline{R})}\int_{Element} I^t(l)e^{-j\beta l(\hat{p}\perp\hat{s})}E\,dl,$$

where, $I^t(l)$, is the current distribution on the element located at $\overline{R}$, $I^t(\overline{R})$ is the current at the terminals of the scattering element (e.g. at the center of a dipole antenna), $\hat{s}$ is the unit vector denoting the plane wave incident direction, and $\beta=2\pi/\lambda$ is the wave number. The unit vectors ${}_\perp\hat{n}$ and ${}_\parallel\hat{n}$, which describe the electric field polarization, are defined by:

$${}_\perp\hat{n} = \frac{-\hat{x}r_z + z\hat{r}_x}{\sqrt{r_x^2 + r_z^2}},$$

and, $${}_\parallel\hat{n} = {}_\perp\hat{n}'\hat{r} = \frac{1}{\sqrt{r_x^2 + r_z^2}}[-x\hat{r}_x r_y + \hat{y}(r_x^2 + r_z^2) - z\hat{r}_y r_z]$$

The quantities ${}_\perp P$, and ${}_\parallel P$, are given by multiplying the pattern function by the appropriate direction cosine: ${}_\perp P = \hat{p}\square{}_\perp\hat{n}P$, and ${}_\parallel P = \hat{p}\square{}_\parallel\hat{n}P$. The effective terminal current $I_A$ which enters the equation for the scattered electric field is obtained from the induced voltage and the impedance as:

$$I_A = \frac{V}{Z_A + Z_L},$$

where $Z_L$ is the self-impedance of the scattering element, and $Z_A$ is the impedance of the array.

As in all moment methods, some approximation must be made regarding the detailed current distribution on the scattering elements 20, 22. In order to calculate the pattern function, we assume the current distribution to be a superposition of current modes. The lowest order mode is taken to be a sinusoidal distribution of the form:

$$I_0(z) = \cos(\pi z/l)$$

where, we have assumed the scattering element to be a conductor of length l centered at the origin. Thus the lowest order mode corresponds to an oscillating current-distribution of wavelength λ=2l. This lowest order mode gives rise to a radiation pattern equivalent to a dipole antenna with a current source at the center of the dipole. In effect, this mode divides the scattering elements 22 of FIG. 2 into two segments. The next two higher order modes are constructed by dividing each half of the scattering element 22 into two more segments, so that each scattering element 22 is effectively composed of four equal-sized segments 22*a*. These modes are written as:

$$I_{1,2}(z)=\cos[2\pi(z\mp l/4)/l].$$

Physically these modes correspond to current distributions of wavelength $\lambda=l$ centered at $\pm l/4$. Thus, the construction of the first three current modes naturally divides each of the scattering elements into four segments 22*a*, as indicated on the first two elements 22 of the array 12 in FIG. 2A. The solution of the problem is then obtained by solving a matrix problem to determine the coefficients of the various modes in the expansion of the currents. For the frequencies considered in this study only the lowest order mode was required making the calculations extremely fast.

We now turn to a discussion of the scattering properties of a partially conducting plasma element.

Scattering from a Partially Conducting Cylinder

In order to calculate the reflection from an array of plasma elements we make the physically reasonable assumption that (to first order) the induced current distribution in a partially-conducting plasma differs from that of a perfectly conducting scattering element only to the extent that the amplitude is different. In the limit of high conductivity the current distribution is the same as for a perfect conductor and in the limit of zero conductivity the current amplitude is zero.

The scattered electric field is directly proportional to the induced current on the scattering element. In turn, the reflectivity is thus directly proportional to the square of the induced current in the scattering element. Thus, to find the reflectivity of the plasma array, we determine the functional dependence of the induced squared current vs. the electromagnetic properties of the plasma and scale the reflectivity obtained for the perfectly conducting case accordingly.

In order to obtain the scaling function for the squared current we consider the following model problem. We solve the problem of scattering from an infinitely extended dielectric cylinder possessing the same dielectric properties as a partially-ionized, collisionless plasma. We thus assume the dielectric function for the plasma to take the following form:

$$\varepsilon(\omega) = 1 - \frac{\nu_p^2}{\nu^2},$$

where, $\nu$ is the frequency of the incident electromagnetic wave, and $\nu_p$ is the plasma frequency defined by:

$$\nu_p = \frac{1}{2\pi}\sqrt{\frac{4\pi n e^2}{m}},$$

where n is the density of ionized electrons, and e, and m are the electron charge and mass respectively. A good conductor is characterized by the limit of large plasma frequency in comparison to the incident frequency. In the limit in which the plasma frequency vanishes, the plasma elements become completely transparent.

We now turn to the solution of the problem of scattering from a partially conducting cylinder. The conductivity, and thus the scattering properties of the cylinder are specified by the single parameter $\nu_p$. We must solve the wave equation for the electric field:

$$\nabla^2 E = \frac{1}{c^2}\frac{\partial^2 D}{\partial^2 t},$$

subject to the boundary conditions that the tangential electric and magnetic fields must be continuous at the cylinder boundary. We consider the scattering resulting from the interaction of the cylinder with an incident plane wave of a single frequency. Therefore we assume all fields to have the harmonic time dependence:

$$e^{-i\omega t},$$

where $\omega=2\pi\nu$, is the angular frequency. We are adopting the physics convention for the time dependence. Personnel more familiar with the electrical engineering convention can easily convert all subsequent equations to that convention by making the substitution $i\rightarrow -j$.

Next we assume the standard approximation relating the displacement field to the electric field via the dielectric function:

$$D(\omega)=\epsilon(\omega)E(\omega).$$

By imposing cylindrical symmetry, the wave equation takes the form of Bessel's equation:

$$\frac{\partial^2 E}{\partial^2 \rho} + \frac{1}{\rho}\frac{\partial E}{\partial \rho} + \frac{1}{\rho^2}\frac{\partial^2 E}{\partial \varphi^2} + \varepsilon k^2 E = 0,$$

where $k=\omega/c$, and $(\rho,\phi)$ are cylindrical polar coordinates. The general solution of this equation consists of linear combinations of products of Bessel functions with complex exponentials. The total field outside the cylinder consists of the incident plane wave plus a scattered field of the form:

$$E_{out} = e^{jk\rho\cos\varphi} + \sum_{m=-\infty}^{\infty} A_m H_m(k\rho) e^{jm\varphi},$$

where, $A_m$, is a coefficient to be determined and $H_m(k\rho)=J_m(k\rho)+iY_m(k\rho)$, is the Hankel function that corresponds to outgoing cylindrical scattered waves. The field inside the cylinder contains only Bessel functions of the first kind since it is required to be finite at the origin:

$$E_{in} = \sum_{m=-\infty}^{\infty} B_m J_m(k\rho\sqrt{\varepsilon}) e^{im\varphi}.$$

To facilitate the determination of the expansion coefficients $A_m$ and $B_m$ we write the incident plane wave as an expansion in Bessel functions:

$$e^{ik\rho\cos\varphi} = \sum_{m=-\infty}^{\infty} i^m J_m(k\rho).$$

To enforce continuity of the electric field at the boundary of the cylinder, we set $$E_{in}(\rho=\alpha,\phi)=E_{out}(\rho=\alpha,\phi),$$

where we have assumed the cylinder to have radius a. The next boundary condition is obtained by imposing continuity of the magnetic field. From one of Maxwell's equations (Faraday's law) we obtain:

$$\overline{H}=-i(1/k)\nabla\overline{E}.$$

Up to this point we have tacitly assumed that the electric field is aligned with the cylinder axis (TM polarization). This is the only case of interest since the scattering of the TE wave is minimal. The tangential component of the magnetic field is thus:

$$H_\varphi = -i(l/k)\left[-\frac{\partial E_z}{\partial \rho}\right]$$

By imposing the continuity of this field along with the continuity of the electric field, we obtain the following set of equations that determine the expansion coefficients:

$$i^m J_m(ka) + A_m H_m(ka) = B_m\left(ka\sqrt{\varepsilon}\right),$$

and $$i^m J'_m(ka) + A_m H'_m(ka) = B_m J'_m\left(ka\sqrt{\varepsilon}\right)\sqrt{\varepsilon},$$

where the primes on the Bessel and Hankel functions imply differentiation with respect to the argument.

These equations are easily solved for the expansion coefficients:

$$A_m = \frac{-i^m\left(\sqrt{\varepsilon}\, J_m(ka)J'_m\left(ka\sqrt{\varepsilon}\right) - J'_m(ka)J_m\left(ka\sqrt{\varepsilon}\right)\right)}{\left(\sqrt{\varepsilon}\, H_m(ka)J'_m\left(ka\sqrt{\varepsilon}\right) - H'_m(ka)J_m\left(ka\sqrt{\varepsilon}\right)\right)},$$

and, $$B_m = \frac{i^m(J_m(ka)H'_m(ka) - J'_m(ka)H_m(ka))}{H'_m(ka)J_m\left(ka\sqrt{\varepsilon}\right) - \sqrt{\varepsilon}\, H_m(ka)J'_m\left(ka\sqrt{\varepsilon}\right)}.$$

Inspection of these coefficients shows that in the limit $\epsilon\rightarrow 1$, (i.e. zero plasma frequency) we obtain $A_m\rightarrow 0$, and $B_m\rightarrow i^m$. Thus in this limit, the scattered field vanishes and the field inside the cylinder simply becomes the incident field as expected.

The opposite limit of a perfectly conducting cylinder is also established fairly easily but requires somewhat more care. Consider first the field inside the cylinder, which must vanish in the perfectly conducting limit. A typical term in the expansion of the electric field inside the cylinder is of the form:

$$B_m J_m\left(k\rho\sqrt{\varepsilon}\right).$$

The perfect conductivity limit corresponds to taking the limit $\nu_p\rightarrow\infty$, at fixed $\nu$. In this limit $\epsilon\rightarrow-\nu_p^2/\nu^2$, and thus $$\sqrt{\varepsilon} \rightarrow i\nu_p/\nu.$$

For large imaginary aregument the Bessel functions diverge exponentially. Therefore we can see:

$$B_m J_m\left(k\rho\sqrt{\varepsilon}\right) \rightarrow O\left(\frac{\nu}{\nu_p}\right) \rightarrow 0.$$

Lastly we must establish that the tangential electric field just outside the cylinder vanishes in the perfect conductivity limit as expected. Using the fact that the Bessel functions diverge exponentially for large imaginary argument gives the following limit for the scattered wave expansion coefficient:

$$A_m \rightarrow \frac{-i^m J_m(ka)}{H_m(ka)}.$$

Thus a typical term in the expansion for the scattered wave, evaluated just outside the cylinder, has the following limit:

$$A_m H_m(k\alpha)\rightarrow -i^m J_m(k\alpha),$$

which exactly cancels the corresponding term in the expansion of the incident plane wave.

The Scaling Function

We now wish to use the results from the analysis of the scattering from a partially conducting cylinder to obtain a reasonable approximation to the scattering from a partially conducting array as represented in FIG. 1A or FIG. 2 based on the computed results for a perfectly conducting array.

We proceed based on the following observations/assumptions: (1) The reflectivity of the array is determined entirely in terms of the scattered field in contrast to the transmitted field which, depends on both the incident and scattered fields; (2) The shape of the current modes on the partially conducting (plasma) array is the same as for the perfectly conducting array; and (3) The only difference between the partially conducting and perfectly conducting arrays is the amplitude of the current modes.

We therefore conclude that the reflectivity of the plasma array can be determined from that of the perfectly conducting array by scaling the reflectivity of the perfectly conducting array by some appropriately chosen scaling function. This conclusion follows from the fact that the reflectivity is directly proportional to the squared amplitude of the current distribution on the scattering elements.

We obtain the scaling function by making the following approximation. We assume that the amplitude of the current on a finite scattering segment in an array scales with the plasma frequency in the same way as that for the isolated, infinitely-long cylinder.

We define the scaling function as:

$$S(\nu,\nu_p)=1.0-|E_{out}|^2,$$

where $E_{out}$ is the total tangential electric field evaluated just outside of the cylinder.

Clearly, from the results of the previous section, the scaling function takes on the values:

$$0.0 \leqq S(\nu,\nu_p) \leqq 1.0,$$

for fixed incident frequency $\nu$, as the plasma frequency takes on the values:

$$0.0 \leqq \nu_p \leqq \infty.$$

In FIG. 1B, the scaling function is plotted versus plasm frequency $\nu_p$, for several values of the incident frequency. The function is illustrated for incident frequencies of 0.1 GHz, 0.5 GHz, 1.5 GHz, and 2.5 GHz between plasma frequencies of 0-20 GHz. As shown, the scaling function increases from zero to near unity at about the same rate for each incident frequency.

We now present results for two cases: (1) an array designed to have a well-defined reflection resonance near 1 GHz, (a band stop filter) and (2) an array designed to operate as a good reflector for similar frequencies.

Switchable Band Stop Filter

The first array considered has a construction like that illustrated by FIG. 2. For this example, each scattering element 22 of FIG. 2 is assumed to be 15 cm in length and 1 cm in diameter. The vertical separation is taken to be 18 cm while the lateral separation is taken to be 10 cm.

The results for the perfectly conducting case along with those for several values of the plasma frequency are presented in FIG. 1C. As seen in FIG. 1C, well-defined reflectivity resonance for the perfect conductor and plasma frequencies of 10.0 GHz and 5.0 GHz exists at a transmission frequency of 1 GHz. The graph further indicates that appreciable reflection occurs only for plasma frequencies above 2.5 GHz, while a plasma frequency of 1.0 GHz produces almost no reflectivity.

Figure 1E:
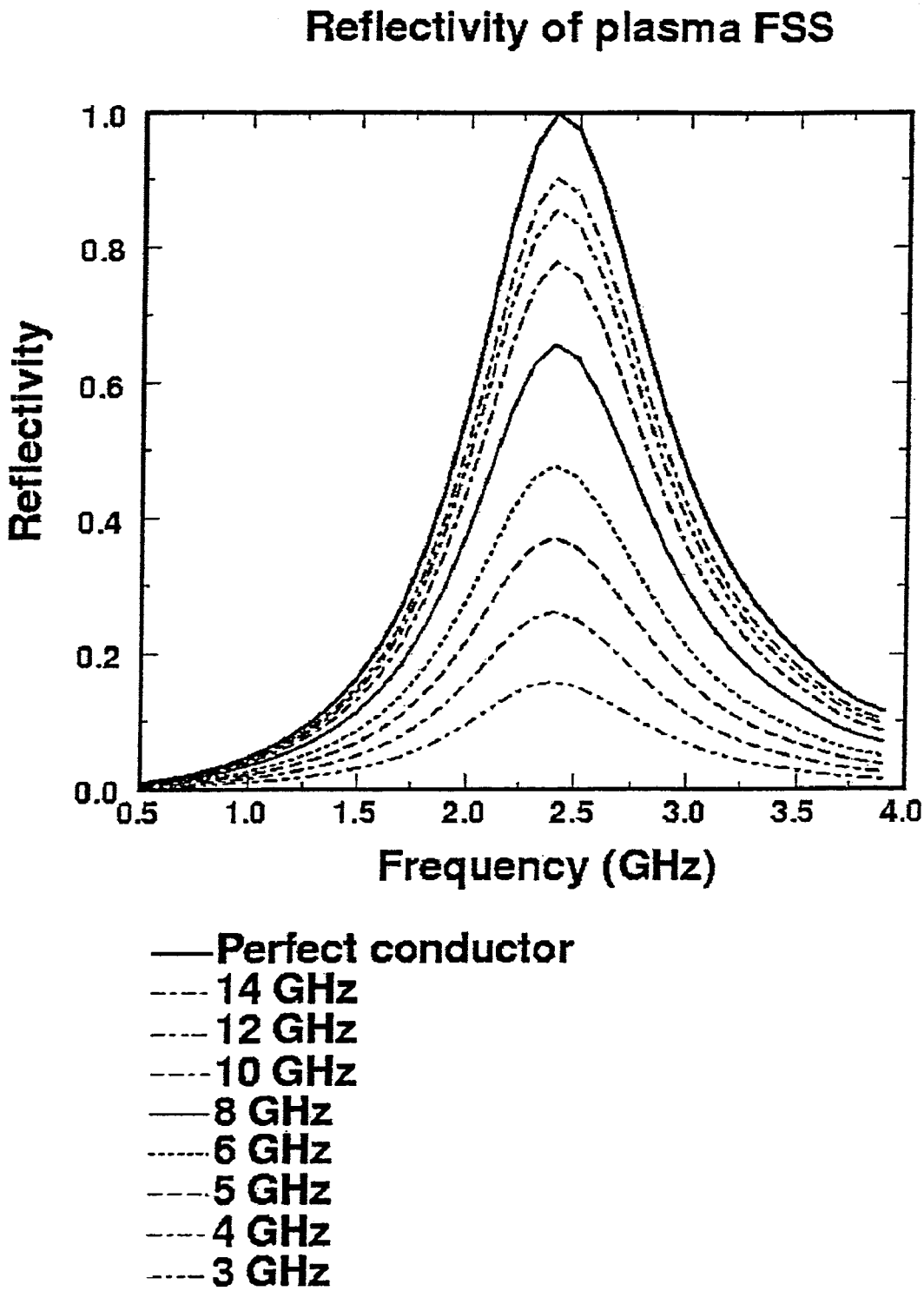
FIG. 1E is a graph plotting reflectivity versus frequency for a second plasma FSS.

A second example of reflectivity in this type of array is illustrated in the graph of FIG. 1E. The array has a construction like that illustrated by FIG. 2. Each scattering element 22 is assumed to be 6.75 cm in length and 0.45 cm in diameter. The vertical separation is taken to be 8.1 cm while the lateral separation is taken to be 4.5 cm.

The results for the perfectly conducting case along with those for several values of the plasma frequency are presented in FIG. 1E. As seen in FIG. 1E, well-defined reflectivity resonance for the perfect conductor and plasma frequencies of 14 GHz, 12 GHz, 10 GHz, 8 GHz, 6 GHz, 5 Ghz, 4 GHz, and 3 GHz exists at a transmission frequency of 2.4 GHz, indicating a Wi-Fi application. The graph further indicates that appreciable reflection occurs only for plasma frequencies above 8 GHz, while a plasma frequency of 3.0 GHz produces small reflectivity.

The results illustrated by FIGS. 1C and 1E demonstrate the essence of the plasma array 10, 12: the array 10, 12 can be configured as a highly reflective band stop filter simply by controlling the properties of the plasma. Further, one familiar with plasma-containing elements will understand that the filter can be nearly instantaneously activated and deactivated merely by supplying or removing power.

Switchable Reflector

Next we consider a structure designed to be a switchable reflector. By placing the scattering elements closer together we obtain a structure that acts as a good reflector for sufficiently high frequencies. An array 12, again having the same general structure as in FIG. 2, but with the scattering elements 22 more densely packed, is used. For this example, the length, diameter, vertical and lateral spacing are 10 cm, 1 cm, 11 cm, and 2 cm, respectively.

The calculated reflectivity for the perfectly conducting case as well as for several values of the plasma frequency is presented in FIG. 1D. For frequencies between 1.8 GHz and 2.2 GHz the array 12 operates as a switchable reflector, dependent upon the plasma frequency in the scattering elements 22. That is, by changing the plasma frequency from low (about 1.0 GHz) to high (10.0 GHz or more) values, the reflector goes from perfectly transmitting to highly reflecting.

A theory of plasma dipole array 10, 12 as shown in FIGS. 1A and 2 has been presented and two specific configurations of the array of FIG. 2 have been analyzed. The theory is based on the physically reasonable assumption that the current modes induced in the plasma scattering elements 20, 22 have the same form but different amplitude from those for a perfect conductor. The reflectivity of the structure is directly proportional to the squared amplitude of the current distribution induced in the scattering elements by the incident radiation. Based on this observation, it is clear the reflectivity of a plasma array structure can be obtained from that for a perfectly conducting structure by scaling the reflectivity with an appropriately chosen scaling function.

The scaling function is defined based on the results of the exactly solvable model of scattering from an infinitely long partially conducting cylinder. The scaling of the current amplitude vs. plasma frequency in the plasma FSS array is approximated as an isolated infinitely long partially conducting cylinder.

The reflectivity for a perfectly conducting array, obtained by the Periodic Moment Method, is then scaled to obtain the reflectivity of the plasma array vs. plasma frequency. The results of these calculations, as illustrated in FIGS. 1C and 1D, support the concept that switchable filtering behavior can be obtained with the use of the plasma array 10, 12 of FIG. 1A or 2.

With respect to FIGS. 1 and 2, it should be observed that while the arrays 10, 12 have been described as elements 20, 22 supported on dielectric 30, the arrays 10, 12 may be formed in reverse as well. That is, permanent slots may be formed through a plasma body. By switching the plasma body between conducting and non-conducting states, and/or changing the frequency and plasma density, the effective size of the slots can be changed, so that the array filters different frequencies. Thus, unlike a conventional radome, for example, with bandpass slots configured for a selected frequency, the array of the invention may also include fixed slots, but be reconfigurable to pass different frequencies electronically rather than mechanically.

Figure 3:
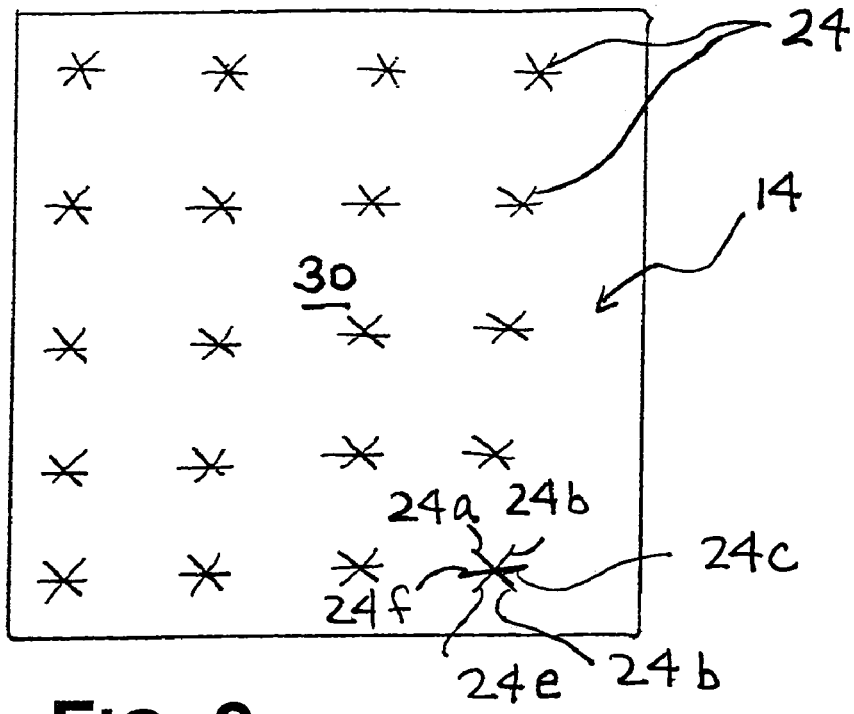
FIG. 3 is a schematic representation of a polarizer in the form of a planar array of spoked variable conductive elements on a dielectric surface in a non-conducting state.
Figure 4:
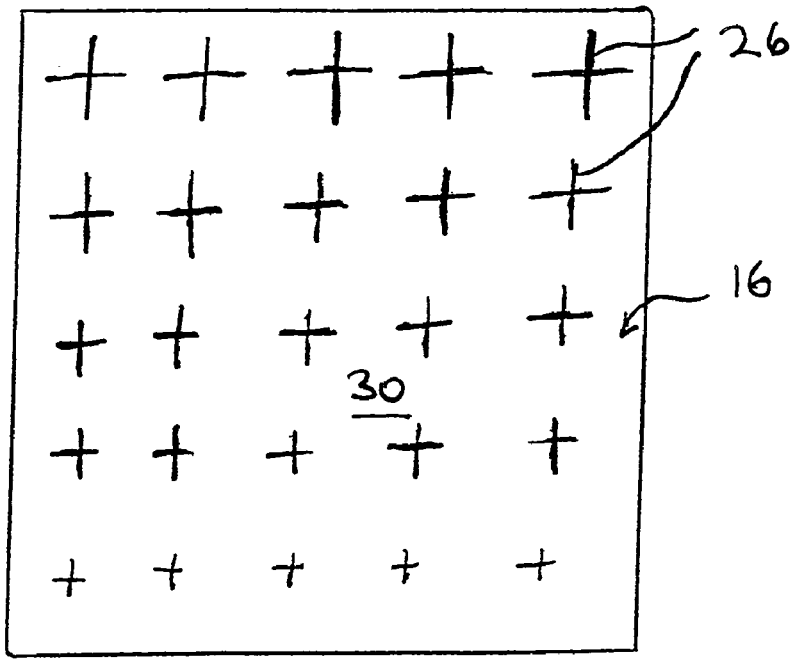
FIG. 4 is a schematic representation of a planar array of progressively sized, variable conductive elements on a dielectric surface in a non-conducting state.

FIGS. 3 and 4 illustrate further embodiments of the arrays 10 in which the plasma-containing elements have different configurations to produce different effects.

FIG. 3 shows an array 14 which can function as a polarizer. Variable conductive scattering elements 24 in the polarizing array 14 are star-shaped. Polarization on different axes is effected by changing the conductivity of the several spokes 24*a-f* of each element 24 in the array 14. By coordinating the conductivities of each spoke 24*a-f* of the several elements 24 in the array 14, a wave passing through the array can be polarized. More importantly, the polarization of an incident signal can be controllably changed simply by changing the conductivities of the spokes 24*a-f*.

In FIG. 4, the array 16 on substrate 30 is composed of variable conductive elements 26 which are sized progressively smaller in each row of the array 16. That is, the top row of elements 26 are largest, while the bottom row of elements 26 are the smallest.

An array 16 as shown in FIG. 4 will produce progressive phase shifting, for example, when the array 16 is positioned ⅛ wavelength above a ground plane (not shown). A standing wave is developed between the dielectric substrate 30 and array 16 and the ground plane. Depending on the effective length of the elements forming the array 16, a phase shift is produced which causes the reflection angle to change. By electrically reconfiguring the length of the variable conductive elements 26 in the array 16, a flat, variable phase shift, steerable antenna is produced having characteristics otherwise similar to a parabolic steerable antenna with fixed phase shifts.

When multiple arrays as shown in FIGS. 1A, 2, 3 and 4 are used in combination, selective filtering and other effects can be produced. Any of the arrays 10-16 can be driven by feeds as well to act as a transceiving antenna, rather than simply powered for producing particular effects. For example, a driven array 10 of dipoles as in FIG. 1A, can be combined with a polarizing array 14 as in FIG. 3, a bandpass array 10, 12 of FIG. 1A or 2 and a phase shifting array 16 of FIG. 4 to transmit polarized electromagnetic waves at selected frequencies in specific, changeable, radial directions. The arrays 10-16 used should all be spaced within one wavelength of the transmitted frequency of each other. Alternatively, as discussed herein, the arrays 10-16 can be combined for use with other driven antennas to control their radiation patterns.

While the variable conductive elements 20, 22, 24, 26 illustrated in FIGS. 1A and 2-4 are preferably dipoles or the shapes indicated, the arrays 10-16 may be formed by elements 20-26 of different geometric shape. Alternate elements may have any antenna or frequency selective surface shape, including dipoles, circular dipoles, helicals, circular or square or other spirals, biconicals, apertures, hexagons, tripods, Jerusalem crosses, plus-sign crosses, annular rings, gang buster type antennas, tripole elements, anchor elements, star or spoked elements, alpha elements, and gamma elements. The elements may be represented as slots through a substrate surrounded by variable conductive surfaces, or solely by variable conductive elements supported on a substrate.

Figure 5A:
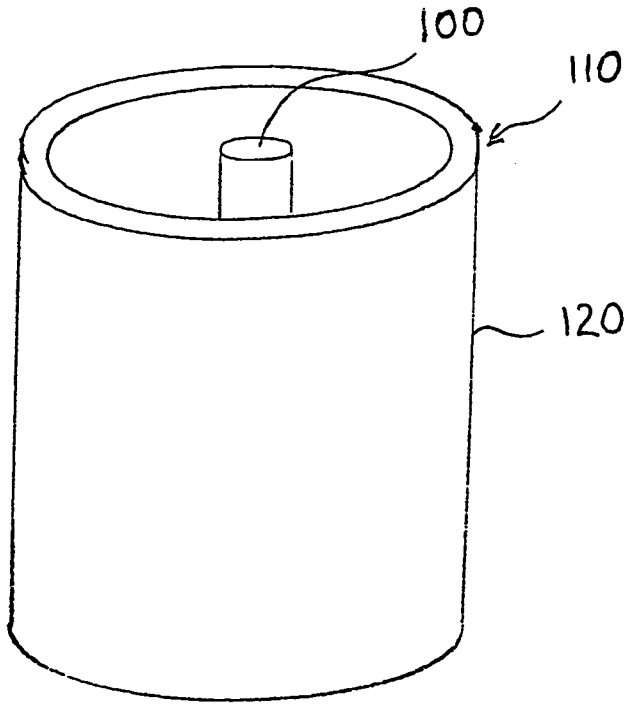
FIG. 5A is a schematic representation of an omnidirectional antenna surrounded by an annular plasma ring.

FIG. 5A shows a steerable antenna 110 of the invention composed of an omnidirectional antenna 100 surrounded by an annular shield 120. Antenna 100 is a dipole, and can be a radiating plasma tube, a conventional metal dipole antenna, or a biconical plasma antenna for broadband radiation. Shield 120 is composed of variably conductive elements which can be switched between conducting and non-conducting states, and made to conduct at different frequencies. In one embodiment, the shield 120 may be formed by a cylindrical array formed by curling one or more of any of arrays 10, 12, 14, 16 illustrated in FIGS. 1A, 2-4. In a preferred embodiment, illustrated in FIGS. 5B and 5F and discussed in greater detail below, the shield 120 is composed of vertically oriented plasma-containing elements 122, such as plasma tube elements. The plasma tubes 122 form a simple array of one row and multiple columns surrounding the antenna 100. The plasma tubes 122 may be mounted in a substrate or other electromagnetically transparent material to assist maintaining their placement.

The configuration of antenna 110 becomes a smart antenna when digital signal processing controls the transmission, reflection, and steering of the internal omnidirectional antenna 100 radiation using the shield 120 to create an antenna lobe in the direction of the signal. Multilobes may be produced in the case of the transmission and reception of direct and multipath signals. The shield 120 is opened or made electrically transparent to the radiation emitted by the omnidirectional antenna 100 using controls to switch sections or portions of the shield 120 between conducting and non-conducting states, or by electrically reducing the density or lowering the frequency of the shield elements 122.

The distance between omnidirectional antenna 100 and plasma shield 120 is important, since for given frequencies, the antenna 110 will be more or less efficient at passing the transmitted frequencies through apertures in the shield 120. Specifically, the release of electromagnetic antenna signals from antenna 100 depends upon the annular plasma shield 120 being positioned at either one wavelength or greater from the antenna 100, or at distances equal to the wavenumber times the radial distance, or kd, to interact with the transmitted signals effectively. Thus, an electromagnetically effective distance between the shield 120 and antenna 100 is one wavelength or greater of the transmitted frequencies the shield is intended to act upon, or at distances corresponding to kd are satisfied, as discussed further herein.

It is envisioned that multiple annular plasma shields 120 can be positioned around the antenna 100 to provide control over transmission of multiple frequencies. For example, only the shield 120 corresponding to a desired transmission frequency could be opened along a particular radial, while all other frequencies are blocked through that aperture by other shields 120.

Figure 5B:
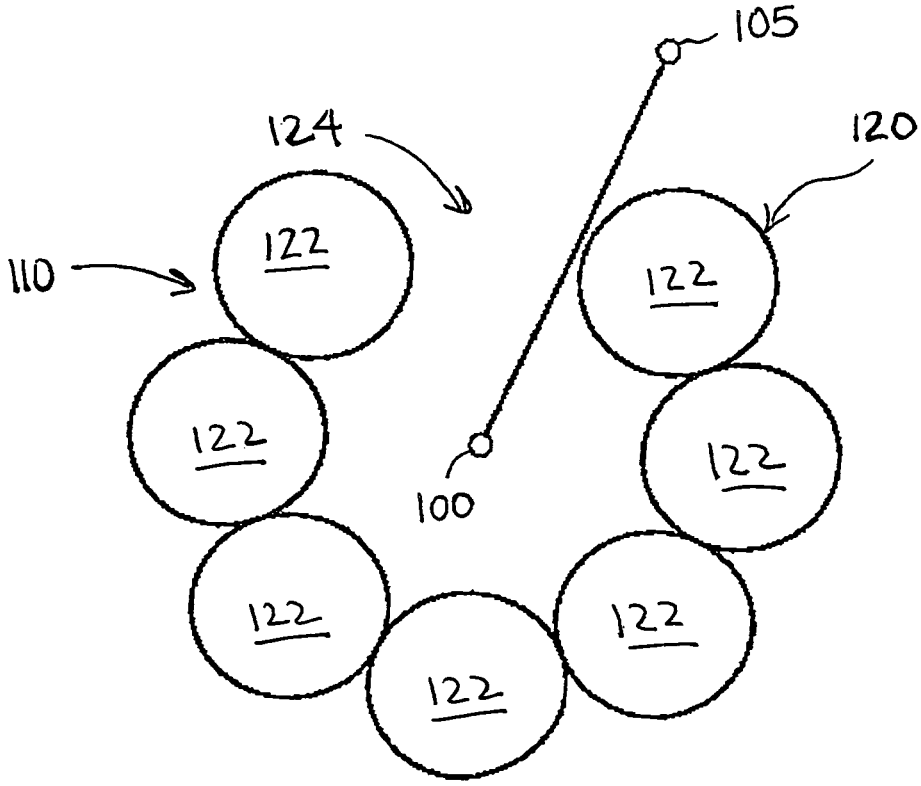
FIG. 5B is a diagram of an omnidirectional antenna surrounded by eight plasma tubes with seven energized.
Figure 5C:
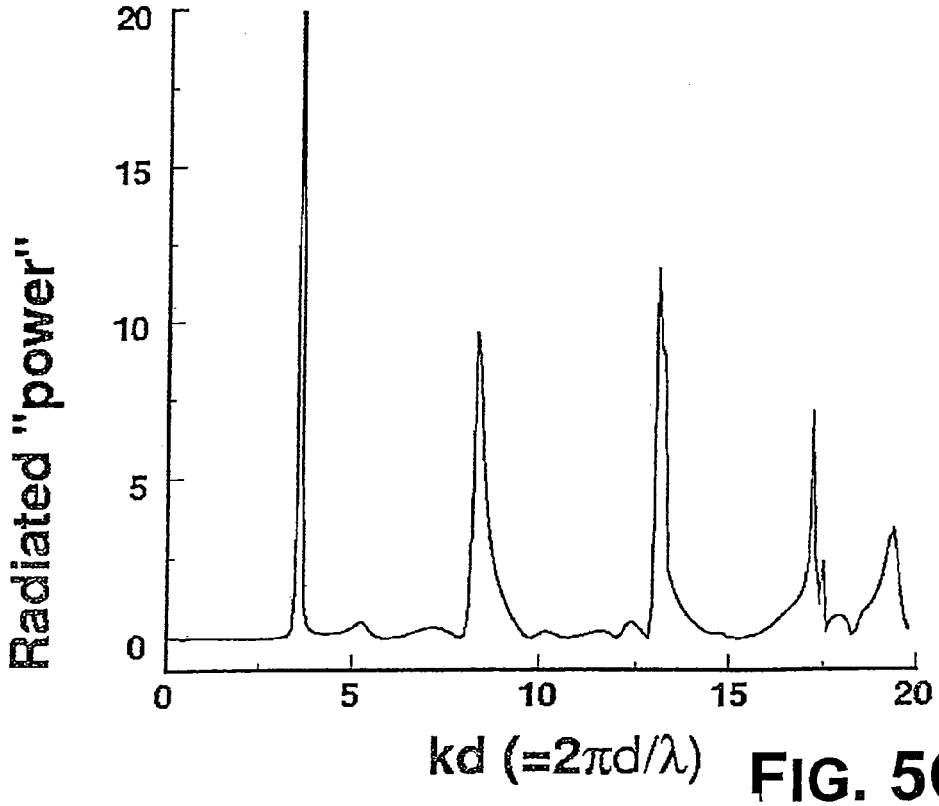
FIG. 5C is a graph showing the theoretical radiation power for the antenna of FIG. 5B.
Figure 5D:
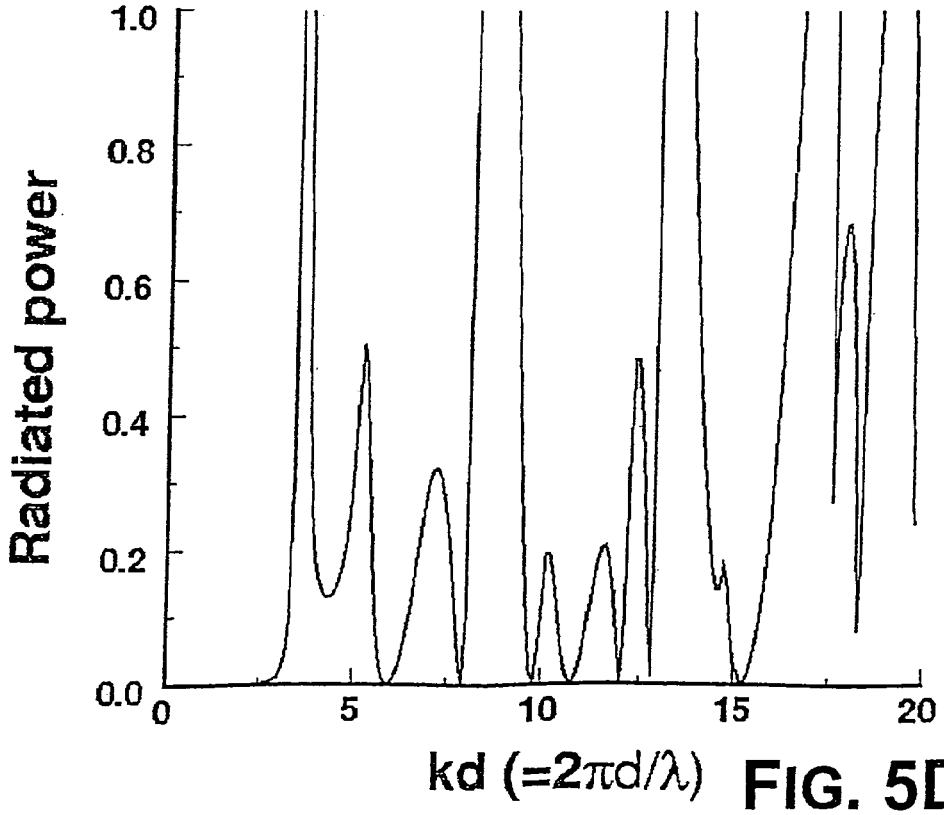
FIG. 5D is a graph showing the actual radiated power from the antenna of FIG. 5B.
Figure 5E:
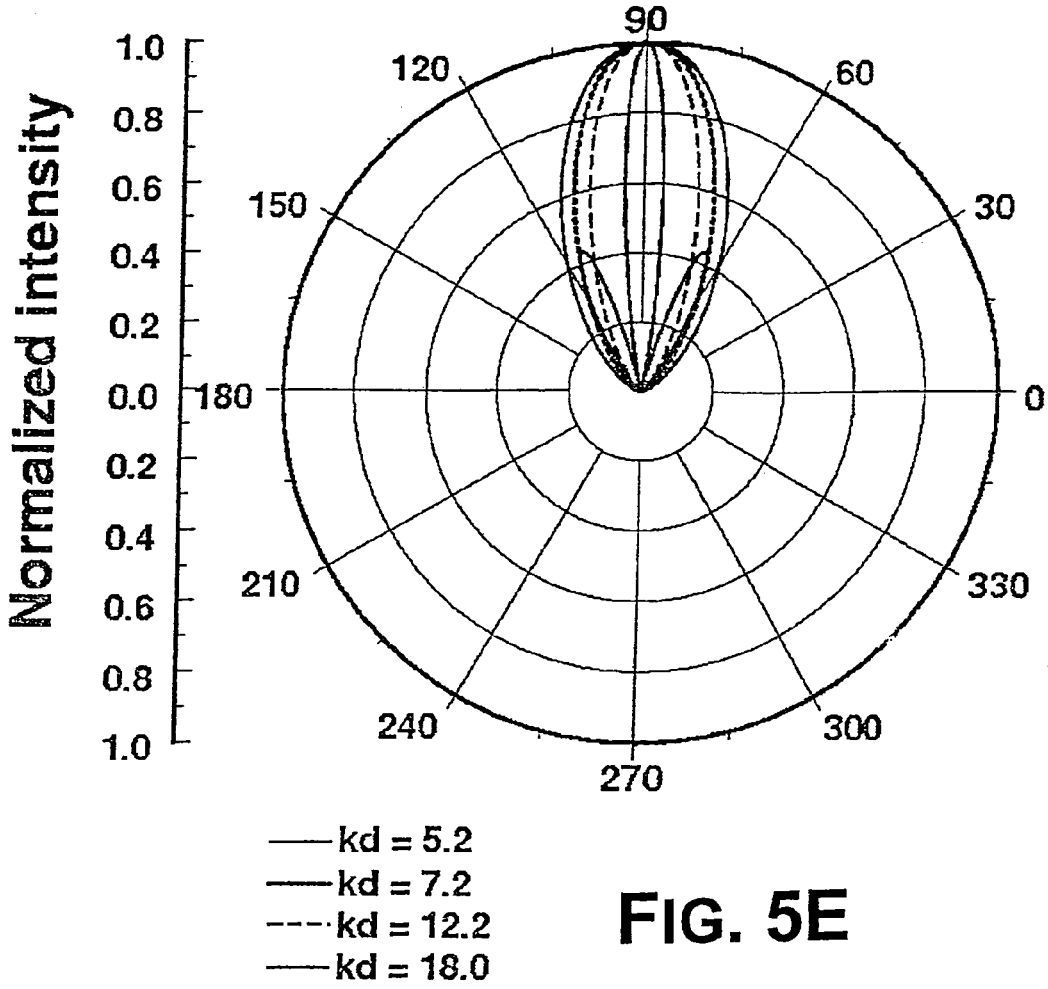
FIG. 5E is a polar graph showing the radiation lobe produced by the antenna of FIG. 5B.
Figure 5F:
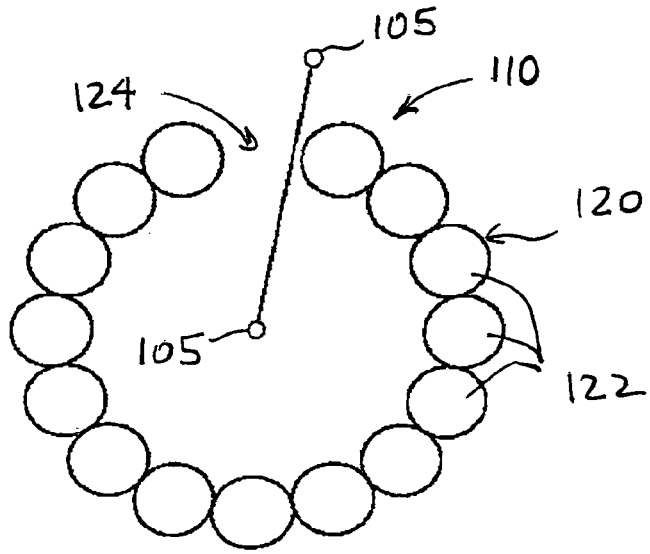
FIG. 5F is a diagram of an omnidirectional antenna surrounded by sixteen plasma tubes with fifteen energized.

FIGS. 5B-J illustrate two embodiments of the antenna 110 of FIG. 5A, and the effect of using each of these two antennas 110 made according to the invention. The following will provide a detailed numerical analysis of the performance of a reconfigurable antenna as shown in FIGS. 5B and 5F. The antenna 110 in each case is comprised of a linear omni-directional antenna 100 surrounded by a cylindrical shell of conducting plasma elements 122 forming plasma shield 120. Preferably, the plasma shield 120 consists of a series of tubes 122 containing a gas, which upon electrification, forms a plasma. In one embodiment, for example, fluorescent light bulbs are used for tubes 122. The plasma is highly conducting and acts as a reflector for radiation for frequencies below the plasma frequency. Thus when all of the tubes 122 surrounding the antenna are electrified and the plasma frequency is sufficiently high, all of the radiation from omnidirectional antenna 100 is trapped inside the shield 120.

By leaving one or more of the tubes 122 in a non-electrified state or lowering the frequency below the transmission frequency of antenna 100, apertures 124 are formed in the plasma shield 120 which allow transmission radiation to escape. This is the essence of the plasma window-based reconfigurable antenna. The apertures 124 can be closed or opened rapidly, on micro-second time scales in the case of plasma, simply by applying and removing voltages.

The following analysis is the prediction of the far-field radiation pattern for a plasma window antenna (PWA) having a given configuration. The configurations of FIGS. 5B and 5F are considered in this analysis.

In order to simplify the analysis, the assumption is made that the exact length of the antenna and surrounding plasma tubes are irrelevant to the analysis. For this purpose, it is assumed the tubes are sufficiently long so that end effects can be ignored. As a result, the problem becomes two-dimensional and permits an exact solution.

The problem is therefore as follows. First, assume a wire (the antenna 100) is located at the origin and carries a sinusoidal current of some specified frequency and amplitude. Next, assume that the wire is surrounded by a collection of cylindrical conductors (plasma tubes 122) each of the same radius and distance from the origin. Then, solve for the field distribution everywhere in space, to thereby obtain the radiation pattern.

FIG. 5B shows the configuration when the PWA 110 has seven active conductors 122 in the shield 120. The following simple geometric construction for creating the plasma shield 120 is used. For forming a complete shield 120, N cylinders 122 are placed with their centers lying along a common circle chosen to have the source antenna 100 as its center. Some distance from the origin d is selected as the radius. The distance can be calculated to produce optimal results for a given PWA 110 frequency, but should be within one wavelength to be effective. Then, the circle of radius d is divided into equal segments subtending the angles:

$$\Psi_l=2\pi l/N,$$

where the integer l takes on the values l=0, 1, . . . (N−1). The apertures 124 are modeled by simply excluding the corresponding cylinders from consideration. Thus, for example, the mathematical model of FIG. 5B was generated by first constructing the complete shield 120 corresponding to N=8. Then, the illustrated structure having one aperture 124 was obtained excluding the cylinder corresponding to l=2, where we have numbered the cylinders assuming the angle to be measured from the positive x-axis (i.e, extending 90° to the right).

Until this point we have considered only touching cylinders, however, there is no need to restrict our attention only to touching cylinders. In the following analysis, it is convenient to specify the cylinder radius through the use of a dimensionless parameter $\tau$, which takes on values between zero and unity (i.e. $0\leqq\tau\leqq1$) where $\tau=0$ corresponds to a cylinder of zero radius (i.e. a wire or linear conductor) and $\tau=1$, corresponding to the case of touching cylinders. More explicitly, the radius of a given cylinder (all cylinder radii assumed to be equal) is given in terms of the parameter $\tau$, the distance of the cylinder to the origin d, and the number of cylinders needed for the complete shield N, by the expression:

$$\alpha=d\tau\sin(\pi/N)$$

A number of geometric parameters which are needed in the analysis that follows must first be defined. The coordinates specifying the center of a given cylinder are given in circular polar coordinates by $(d,\Psi_l)$, and in Cartesian coordinates by:

$$d_{lx}=d\cos(2\pi l/N),$$

and $$d_{ly}=d\sin(2\pi l/N).$$

The displacement vector pointing from cylinder l to cylinder q is defined by the equation:

$$\vec{d}_{lq}=\vec{d}_q-\vec{d}_l$$

The magnitude of this vector is given by:

$$|\bar{d}_{lq}|=\sqrt{2}\sqrt{1-\cos(\psi_q-\psi_l)}.$$

It is necessary to find the angle $\Psi_{lq}$ subtended by vectors $\vec{d}_q$ and $\vec{d}_q$. In other words, when considering a triangle consisting of three sides $|\vec{d}_q|$, $|\vec{d}_l|$, and $|\vec{d}_{lq}|$, the angle $\Psi_{lq}$ is the angle opposite to the side $|\vec{d}_{lq}|$. This angle is easily obtained by the following two relations:

$$d_{lq}\cos(\Psi_{lq})=d_q\cos(\Psi_q)-d_l\cos(\Psi_l),$$

and $$d_{lq}\sin(\Psi_{lq})=d_q\sin(\Psi_q)-d_l\sin(\Psi_l).$$

Lastly, the coordinates of the observation point relative to the source as well as with respect to coordinate systems centered on the conducting cylinders are defined. The coordinates of the observation point $\vec{\rho}$ with respect to the source are denoted by $(\rho,\phi)$. The following displacement vector is used to specify the observation point with respect to cylinder q,:

$$\vec{\rho}_q=\vec{\rho}-\vec{d}_q.$$

The coordinates of the observation point in the system centered on cylinder q are thus $(\rho_q,\phi_q)$, which are determined in the same way that the coordinates $d_{lq}$, and $\Psi_{lq}$, were obtained above.

To complete the specification of the geometric problem, one must specify the coordinates of the source with respect to each of the coordinate systems centered on the cylinders. Obviously, the distance coordinate $d_{ls}$ of the source with respect to the coordinate system centered on cylinder l is given by $d_{lq}=d$. The angular coordinate $\Psi_{ls}$, is easily seen to be given by:

$$\Psi_{ls}=\Psi_l+\pi.$$

Next, the electromagnetic boundary value problem is considered. The solution to the boundary value problem is obtained by assuming the cylinders 122 to be perfect conductors, which forces the electric fields to have zero tangential components on the surfaces of the cylinders. Enforcing this condition on each of the cylinders leads to N linear equations for the scattering coefficients. This results in an N'N, linear algebraic problem which is solved by matrix inversion.

The field produced by a wire aligned with the $\hat{z}$-axis, which carries a current I is defined by:

$$\vec{E}_{inc}(\rho)=-\left(\frac{I\pi k\hat{z}}{c}\right)H_0^{(1)}(k\rho),$$

where, k is the wave vector defined by $k=\omega/c$, where c is the speed of light, and the angular frequency $\omega$ is given in terms of the frequency $f$ by $\omega=2\pi f$. The Hankle function of the first kind, of order n (in this case n=0) is defined by:

$$H_n^{(1)}(x)=J_n(x)+iY_n(x),$$

where, $J_n(x)$, and $Y_n(x)$ are the Bessel functions of the first and second kind respectively. It is assumed that all quantities have the sinusoidal time dependence given by the complex exponential with negative imaginary unit exp(−iωt).

The key to solving the present problem hinges on the fact that waves emanating from a given point (i.e. from the source or scattered from one of the cylinders) can be expressed as an infinite series of partial waves:

$$\vec{E}(\rho, \phi) = \hat{z} \sum_{m=-\infty}^{\infty} A_m H_m(k\rho)\exp(-im\phi),$$

where, we have dropped the superscript on the Hankel function, and because of the fact that any given term in the series can be expanded in a similar series in any other coordinate system by using the addition theorem for Hankel functions. The addition theorem for Hankel functions is written:

$$\exp(in\psi)H_n(kR) = \sum_{m=-\infty}^{\infty} J_m(kr')H_{n+m}(kr)\exp(im\varphi)$$

where, the three lengths r', r, and R, are three sides of a triangle such that:

$$R = \sqrt{r'^2 + r^2 - 2rr'\cos(\varphi)},$$

with r'<r, and Ψ is the angle opposite to the side r'. Another way to express this is as follows:

$$\exp(2i\psi) = \frac{r - r'\exp(-i\varphi)}{r - r'\exp(i\varphi)}.$$

A system of N, linear equations for the scattering coefficients is obtained by expanding the total field in the coordinate system of each cylinder 122 in turn and imposing the boundary condition that the tangential component of the field must vanish on the surface of each cylinder 122.

The total field is written as the sum of the incident field $\vec{E}_{inc}$ plus the scattered field:

$$\vec{E}_{scat} = \sum_{q=0}^{N-1} \sum_{n=-M}^{M} A_n^q H_n(k\rho_q)\exp(in\phi_q),$$

where the sum over the angular variable is truncated and terms in the range −M≦n≦M. are retained.

Next a particular cylinder is isolated, for example, cylinder l, and all fields in the coordinate system are expressed as centered on cylinder l. After setting the total field equal to zero and rearranging terms, the following equation results:

$$A_m^l = \sum_{q\neq l} \sum_{n=-M}^{M} \left(-\exp[-i(m-n)\psi_{lq}]\frac{J_m(ka)}{H_m(ka)}H_{m-n}(kd_{lq})\right)A_n^q +$$

-continued $$\left(\frac{\pi\omega I}{c^2}\right)\exp(-im\psi_{ls})\frac{J_m(ka)}{H_m(ka)}H_m(kd_{ls}).$$

This can be written compactly in matrix notation as:

$$A_\alpha = \sum_\beta D_{\alpha\beta}A_\beta + K_\alpha,$$

by adopting the composite index α≡(l,m), and β≡(q,m). By writing this symbolically as A=DA+K, and collecting terms results in: (I−D)A=K, where I is the unit matrix. This equation is solved for the scattering coefficients with matrix inversion to yield:

$$A=(I-D)^{-1}K.$$

The solution derived in the previous section is formally exact. In practice, one chooses a specific range for the angular sums: −M≦n≦M, which leads to a N(2M+1) dimensional matrix problem, the solution of which gives 2M+1 scattering coefficients $A_n^q$. The quality of the solution is judged by successively increasing the value of M until convergence is reached.

Lastly it is convenient to use the addition theorem to express all of the scattered fields in terms of the coordinate system centered on the source. Thus, the equation is written as:

$$\sum_{q=0}^{N-1} \sum_{n=M}^{M} A_n^q H_n(k\rho_q)\exp(in\phi_q) \equiv \sum_{p=-M}^{M} B_p H_p(k\rho)\exp(ip\phi)$$

from which, the new coefficients obtained are:

$$B_p = \sum_{q=0}^{N-1} \sum_{n=-M}^{M} A_n^q J_{p-n}(kd_q)\exp[-i(p-n)\psi_q].$$

Next, the far-field radiation pattern must be defined. For convenience, the amplitude of the source current is selected so as to obtain unit flux in the absence of the cylinders. In other words, the source field is given by:

$$\vec{E}_{inc} = -\sqrt{\frac{2\pi k}{c}}\,H_0(k\rho).$$

It can be verified that this gives the unit flux. The far-field limit of the Hankel function is:

$$H_m(k\rho) \approx \sqrt{\frac{2}{\pi k\rho}}\exp[i(k\rho - ((2m+1)\pi/4],$$

and the magnetic field is obtained from the electric field as:

$$\vec{B}_{inc} = \frac{-ic}{\omega}\nabla' \vec{E}_{inc}.$$

The radiation intensity is obtained from these field by computing the Poynting vector:

$$\vec{P} = \frac{c}{8\pi}\mathcal{R}[\vec{E}'\vec{B}^*].$$

Integrating this over a cylindrical surface of unit height, at a distance ρ, results in the unit flux as stated.

Accordingly, by extracting a factor of $$\sqrt{2\pi k/c},$$

the total electric field can be expressed as:

$$\vec{E} = -\sqrt{\frac{2\pi k}{c}}\left(H_0(k\rho) - \sum_{n=-M}^{M} B_n H_n(k\rho)\exp(in\phi)\right)$$

Using this in the expressions above gives the Poynting vector. The far-field radiation pattern is obtained by plotting the radial component of the Poynting vector at a given distance (in the far field) as a function of angle.

It should be understood that the plasma shields 120 around antennas 100 in each of FIGS. 5B and 5F allow for Fabry-Perot Etalon effect whereby slightly varying the plasma skin depth of closed window portions of the shield will permit some antenna radiation to transmit through the closed window by satisfying the Fabry-Perot Etalon conditions.

Referring again to FIGS. 5C-E and 5G-I, these drawings graphically depict the radiated flux and power, and show the radiation lobes on polar graphs for the antenna 110 configurations of each of FIGS. 5B and 5F, respectively.

Figure 5G:
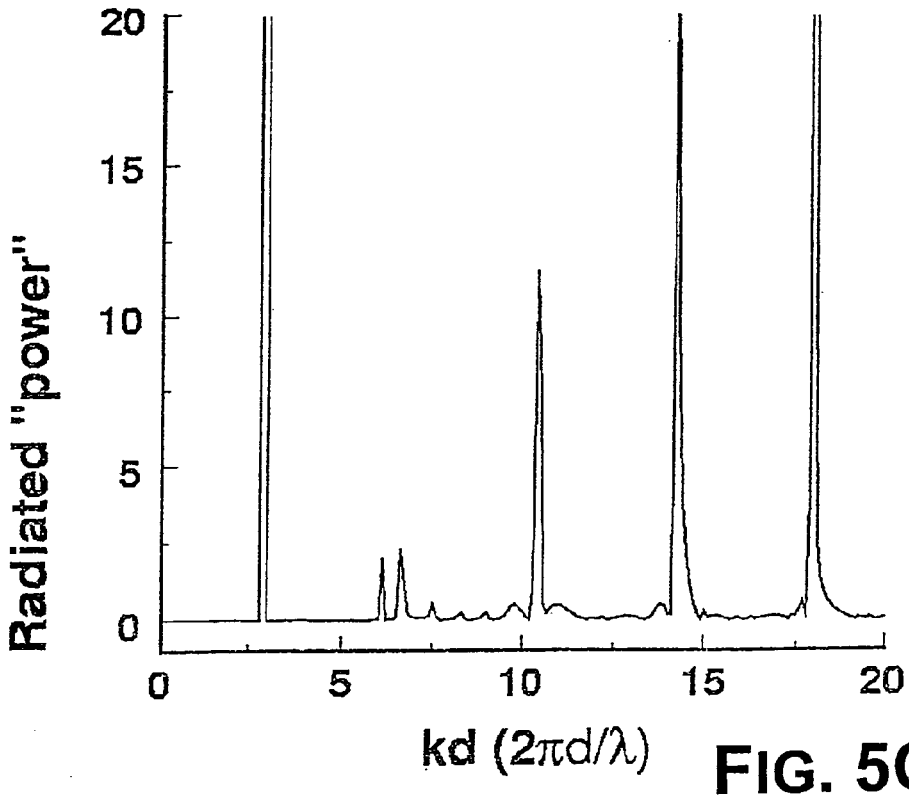
FIG. 5G is a graph showing the theoretical radiation power for the antenna of FIG. 5F.

FIGS. 5C and 5G depict the radiated flux in the far field for the antennas of FIGS. 5B and 5F. The plotted values are obtained by integrating the Poynting vector over a cylindrical surface of unit height in the far field, in accordance with the calculations described above. Values greater than unity indicate the presence of eigenvalues which lead to singular matrices.

Figure 5H:
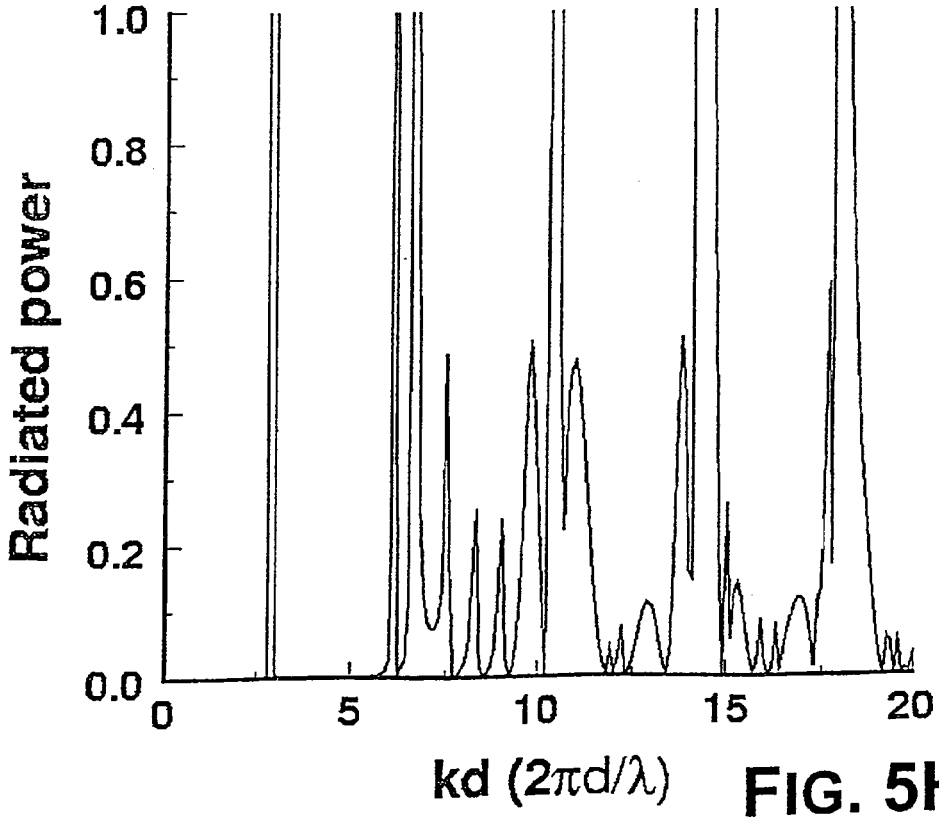
FIG. 5H is a graph showing the actual radiated power from the antenna of FIG. 5F.

FIGS. 5D and 5H show the radiated power from the antennas 110 of FIGS. 5B and 5F, respectively, for physical solutions only. That is, the plotted values are limited to the scale of physically allowable values between 0 and 1.

Figure 5I:
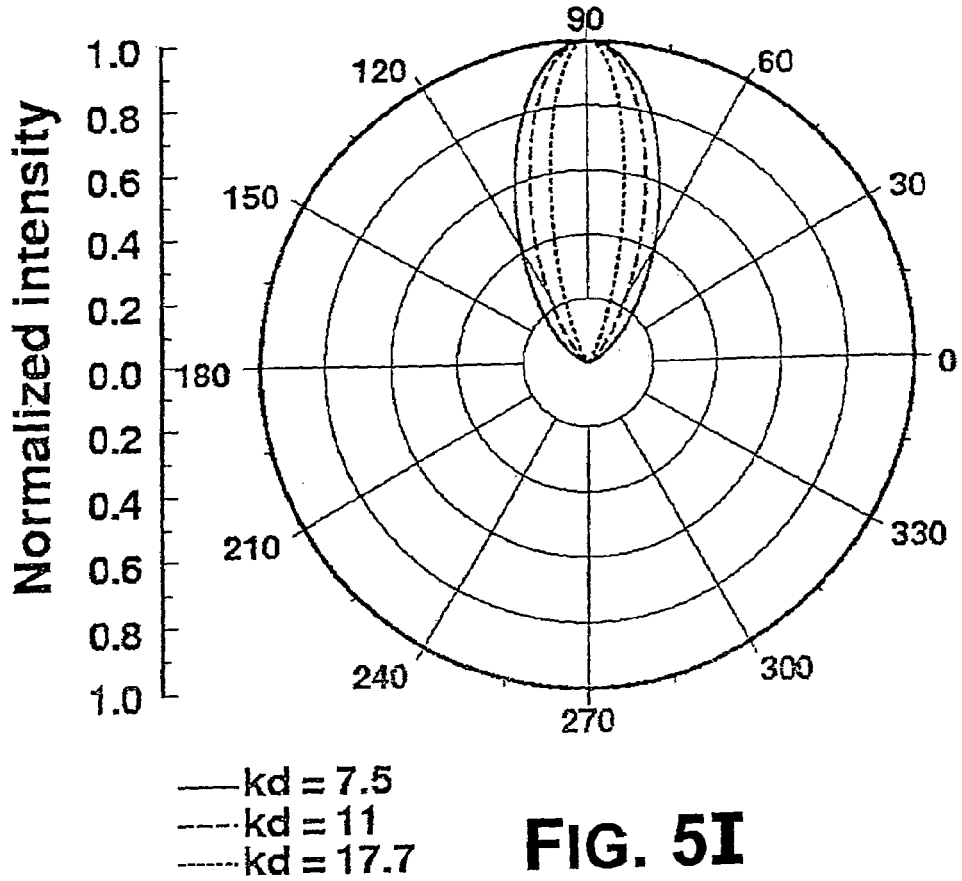
FIG. 5I is a polar graph showing the radiation lobe produced by the antenna of FIG. 5F.
Figure 5J:
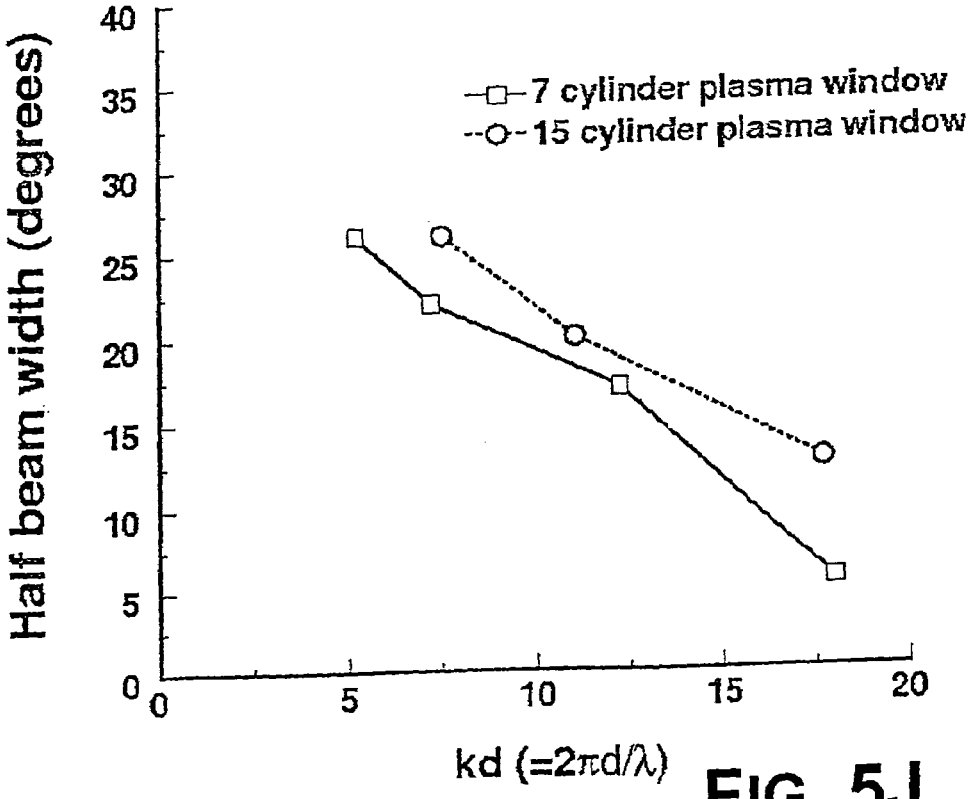
FIG. 5J is a graph showing the beam half width versus angle for the antennas of FIGS. 5B and 5F.

FIGS. 5E and 5I illustrate the radiation lobe patterns on polar graphs for each antenna configuration of FIGS. 5B and 5F, respectively. The radiation lobe patterns are shown for different values of kd. Notably, the radiation lobes are more focused for greater values of kd. The plotted kd values indicate electromagnetically effective spacing between the antenna 110 and shield 120 so they will interact as intended.

Figure 6A:
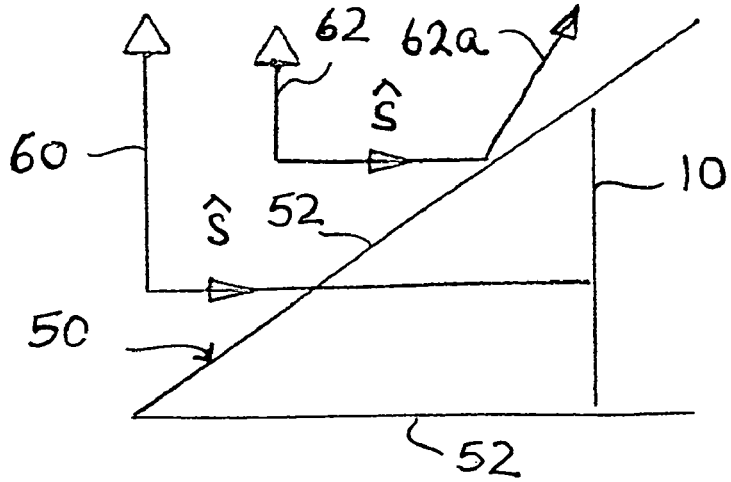
FIG. 6A is a diagram illustrating a V-shaped antenna radome according to the invention including the array of FIG. 1 or 2.

FIG. 6A demonstrates one application for the arrays of FIGS. 1A, and 2-4. In FIG. 6A, a V-shaped tunable radome 50 is shown encasing an antenna array 10. Radome 50 can be part of an airplane fuselage, for example. Radome panels 52 are formed as dielectric layers with arrays of slots surrounded by variable conductive regions, or alternatively, as dielectric layers with variable conductive elements arranged in an array as illustrated in FIG. 1A or 2.

The radome 50 is effectively made tunable by the presence of the variable conductive regions around slots or variable conductive elements in panels 52. When the variable conductive regions or elements are powered, they are opaque to electromagnetic radiation, and when unpowered, they are transparent. Thus, when used in connection with existing non-conductive slots, the effective slot size can be changed. Or, when just variable conductive elements are used, the entire size of the opening through the panels 52 can be controlled directly. Thus, the frequencies permitted to pass through the radome 50 can be controlled.

As shown, an in-band signal 60 and an out-of-band signal 62 are both incident on a panel 52 of the tunable radome 50. The panel 52 is configured to reject the out-of-band signal 62 and deflect, or steer, the reflected signal 62*a* away in a selected direction other than the reverse direction. The radome 50 can effectively reduce the radar cross section to zero for out-of-band signals.

The in-band signal 60, meanwhile, is permitted to pass through the radome panel 52 and is received by array 10. When array 10 is also tunable to different frequencies, the radome 50 and array 10 can be operated in tandem to successively select different frequencies to be in-band, and then switch between them rapidly.

Figure 6B:
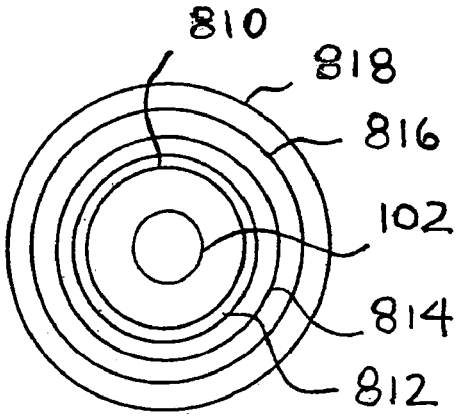
FIG. 6B is a top plan view of a omnidirectional antenna used with layered arrays of the invention.
Figure 6C:
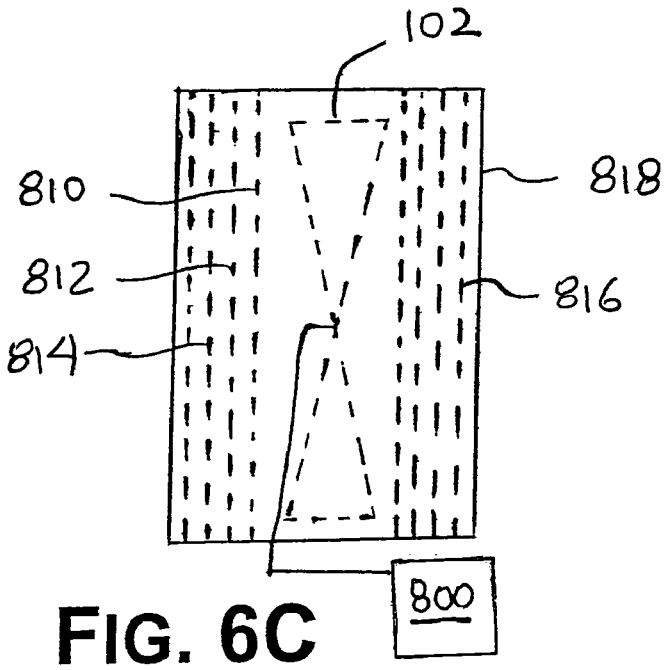
FIG. 6C is a side elevation view of the antenna configuration of FIG. 6B.

A more complex application of the arrays of FIGS. 1A, 2-4 is shown by FIGS. 6B and 6C, in which several of the arrays are arranged in stacked layers 810-818. In each case, the layers 810-818 are selected to produce a particular effect in conjunction with each other on the signal broadcast through the surrounded antenna 102. The antenna 102 shown is a biconical, center-fed antenna, which type of antenna is particularly useful for broadband applications. The biconical antenna 102 is preferably a plasma-filled cone antenna, so that the advantages gained thereby are obtained, including the broad frequency range resulting from different plasma densities along the length of each end of the antenna 102. A transceiver 800 is attached to the antenna 102 through a feed for generating and interpreting signals transmitted through and received from antenna 102.

The array layers 810-818 are arranged concentrically around the antenna 102, and are spaced within one wavelength of the transmitted signals of each other. The optimal spacing between layers, and elements in each layer, can be calculated, as with the shield 120 of FIG. 5A, above. The spacing between antenna 102 and the layers 810-818 is the same as with the shields 120 of FIGS. 5A-J, above. The layers 810-818 are selected to produce a particular effect, such as a selective bandpass filter, polarized transmission, phase shifting, and steering the transmitted signals by using one of the array types of FIGS. 1A, 2-4 for each layer 810-818. The substrate 30 of each array type used is preferably formed into a cylinder, so that the array is equidistant from the antenna 102 at each radial.

For example, each layer 810-818 may be a frequency filter, such as the array of FIG. 1A or FIG. 2. Different frequencies can be selectively filtered by choosing different element 20, 22 configurations in the arrays 10, 12 forming the layers 810-818. That is, for higher frequency filters, more rows and columns of elements 20, 22 should be used in array like that of FIG. 1A or 2, while lower frequencies require fewer elements 20, 22 to block. Biconical antenna 102 can generate several different frequencies due to the changing cross-section of the antenna shape.

The frequency filter formed by layers 810-818 can be used to pass or block particular frequencies within the range affected by the filter on selected radials, while others are permitted to pass. In a preferred arrangement, layer 810 is an array for reflecting, or blocking, the highest frequencies transmitted or received, while layer 818 is an array for reflecting the lowest frequencies. Layers 812-816 are selected to reflect progressively lower frequencies between those affected by layers 810 and 818. It should be appreciated that higher frequencies will continue to pass through lower frequency tuned arrays, even when those arrays are active. But, to pass the lowest frequency signals, all of the shield layers 810-818 must be effectively opened along the desired radial(s) by making the array elements non-conducting in the window where the low frequency signal is transmitted. When the arrays are sufficiently large, it is possible to control transmission and reception in both the radial and azimuth axes by creating a window in the shield layers 810-818 and sequentially opening and closing the window.

Alternatively, one of the layers 810-818 may be a polarizer or phase shifter array, such as illustrated by FIGS. 3 and 4. The shield layers 810-818 work in the same manner as above with respect to received signals. Thus, inclusion of a phase shifter array permits reflection and scattering of certain received signals, such as to avoid active detection of the antenna 102. For example, the layers 810-818 may be designed to deflect incident electromagnetic signals at non-backscattering angles, so as to produce no, or only a very small, radar cross-section. A phase shifter array provides one arrangement for steering incident signals. A further use of the layers 810-818 and antenna 102 is to act as a repeater station, for propagating a received signal along all or selected radials.

It should be understood as within the scope of this invention that the antenna 100 of FIGS. 5B and 5F or antenna 102 of FIGS. 6B-C can be substituted for each other, or other antennas may be used. One alternative antenna configuration which is contemplated combines two or more antennas in the same manner as the arrays 10-16 which are stacked in layers 810-818. That is, a conventional omnidirectional dipole may be surrounded by a co-axially oriented helical antenna, or a plasma biconical antenna may consist of two plasma biconical antennas formed to have one antenna inside the other, in nested configuration. A greater range of different frequencies may be transceived using the nested antennas or dual biconical antenna by producing a higher plasma density in the inner antenna and a lower density in the outer antenna. The higher frequencies produced in the inner plasma biconical antenna will pass easily through the lower plasma density of the outer biconical antenna.

In the case of combining a helical antenna co-axial with another antenna, such as a dipole, a multi-axis antenna is formed when the frequencies are properly selected. The helical antenna will transceive primarily along radiation lobes oriented extending on the longitudinal axis of the helix, while an omnidirectional dipole located along that axis will transceive mainly in a donut shaped region radially surrounding the dipole antenna. The frequencies must be selected similarly to the arrays to ensure proper transmission of higher frequencies through lower ones.

In a further embodiment, the layers 810-818 may consist of transmitting arrays arranged to produce an arbitrary bandwidth antenna. In such case, the layers 810-818 can be used in conjunction with a shield 120 or other filtering array 10-16. The transmitted frequency of layer 810 should be the highest and that of layer 818 the lowest. The layers 810-818 may be turned on and off to produce single and multi-band effects. When used as transmitters, the layers 810-818 need not be within one wavelength of the adjacent layers 810-818, and can be more effective when spaced greater than one wavelength apart from the adjacent layers 810-818. Such spacing does not significantly increase the footprint size of the transmitting antenna in most cases, for example, when used in the millimeter or microwave bands and higher frequencies, such as used by personal or portable electronics.

Further, any of the arrays 10, 12, 14, 16 on substrate 30 may be arranged co-planar or bent to have a particular curvature, such as for parabolic reflectors, or into cylinders, as described above. The arrays 10-16 may alternatively be arranged on the surfaces of one or more planar substrates 30 to form volumetric shapes surrounding an antenna 100 other than cylinders, including closed or open end triangles, cubes, pentagons, etc. While it is preferred that the substrates and arrays form the walls of geometric shapes, the arrays may be conformed to any surface for use, provided the appropriate calculations are done to ensure proper location of the elements for the desired purpose.

Figure 7:
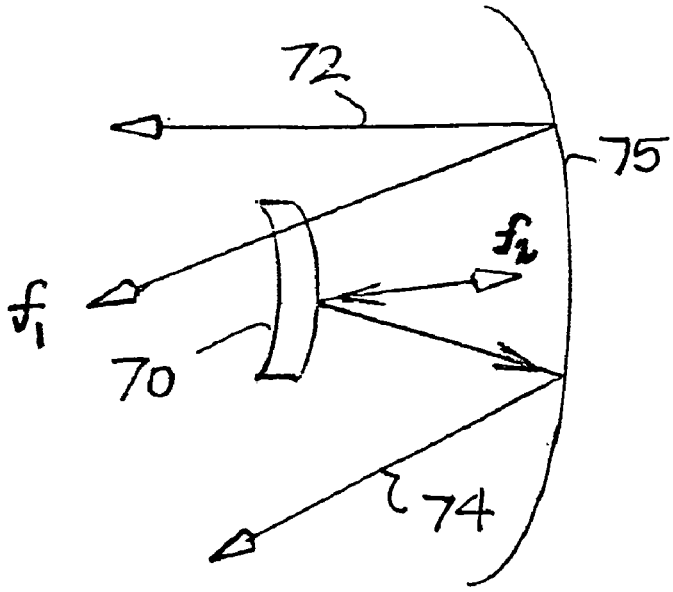
FIG. 7 is a diagram demonstrating a tunable dichroic subreflector having elements like the arrays of FIG. 1 or 2.
Figure 8:
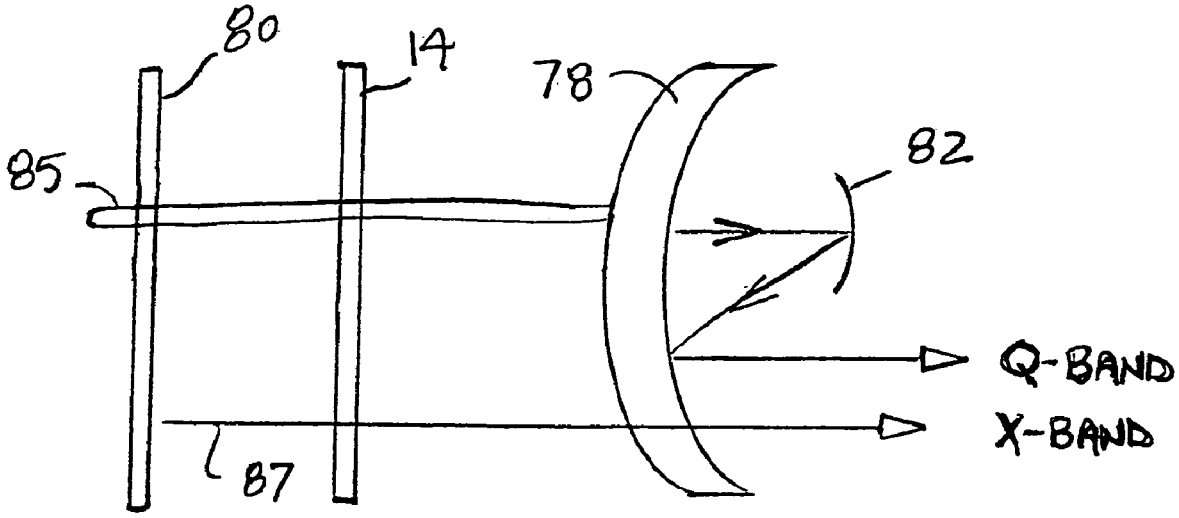
FIG. 8 is a representation of a dichroic surface having an array as in FIG. 1 or 2 combined with the polarizing array of FIG. 3.

FIGS. 7 and 8 illustrate applications of the steerable antennas with dichroic reflectors.

A tunable dichroic subreflector 70 having variable conductive elements as in the arrays of FIGS. 1A and 2-4 is shown in FIG. 7. The subreflector 70 is used to increase or decrease bandwidths. The subreflector 70 is placed at a suitable distance from main reflector 72. The subreflector 70 has variable conductive regions or elements for filtering, reflecting or steering incident beams 72, 74.

FIG. 8 displays a dichroic surface reflector 78 combined with an X-band array 80, polarizing array 14 and subreflector 82. Polarizing array 14 is like that of FIG. 3. Reflector 78 is similar to subreflector 70 of FIG. 7 and includes arrangements of variable conductive regions around slots or variable conductive elements which are configurable for filtering, reflecting or steering different frequencies.

X-band array 80 generates X-band signal 87 which passes through polarizing array 14 and from the back side of reflector 78. X-band signal 87 can either be polarized 87 to a particular polarity or be permitted to pass polarizing array 14 unaffected. Q-band input signal feed 85 also passes through polarizing array 14 and the back surface of reflector 78. Reflector 78 limits the Q-band signal from feed 85 which is then reflected by subreflector 82, and again off front surface of reflector 78. This configuration is intended for increasing or decreasing antenna bandwidth in narrow spaces.

It should be noted that X-band and Q-band signals are used for example only, and the configuration of FIG. 8, like the others disclosed herein can be used to modify signals in other electromagnetic frequency ranges besides those described. For example, optical frequencies can be modified by this configuration when the variable conductive regions or elements are formed by photonic crystals. The use of photonic crystals as variable conductive regions or elements is discussed in greater detail below.

Figure 9A:
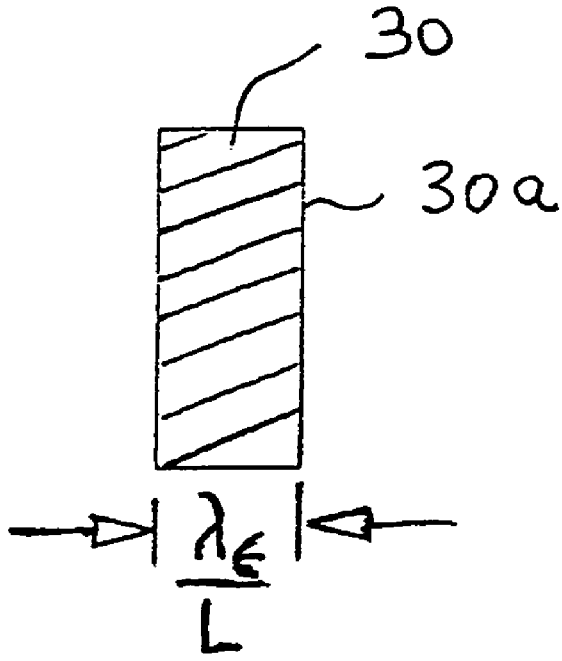
FIG. 9A is a representation of a one half wavelength dielectric surface of the arrays of FIGS. 1-3.

FIG. 9A illustrates a side view of a dielectric substrate 30 as in FIGS. 1A, 2-4, having a dielectric surface of one-half wavelength. A layer 30*a* of the variable conducting elements 20, 22, 24, or 26, is provided on one surface of the dielectric 30. Alternatively, layer 30*a* can be slots with variable conducting regions around the slots.

Figure 9B:
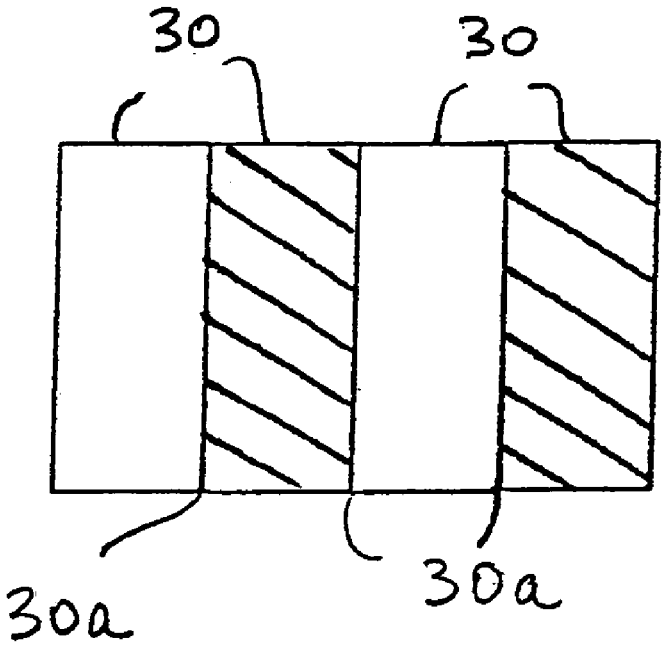
FIG. 9B is a schematic representation of multiple layers forming the dielectric surface of FIG. 9.

FIG. 9B shows several dielectric substrates 30 of half wavelength thickness supporting layers 30*a* of variable conducting elements 20, 22, 24, or 26. The dielectric substrate 30 provides stability in bandwidth and angle of incidence independence to the arrays 10, 12, 14 and 16 of variable conducting elements.

Figure 10:
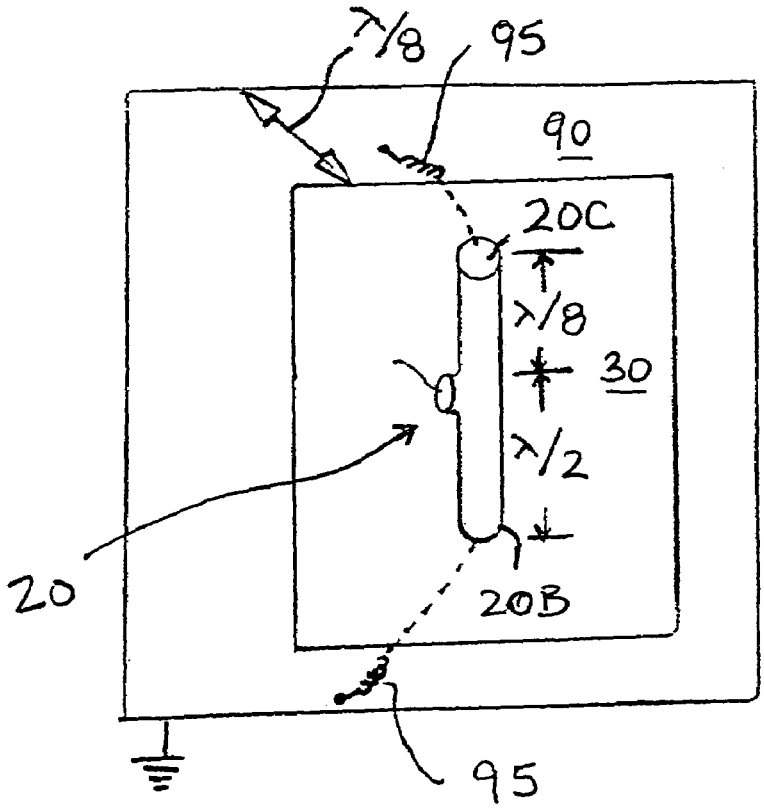
FIG. 10 is a schematic diagram of a four phase state dipole antenna positioned one-eighth wavelength from a ground plane.

Turning now to FIG. 10, a preferred form of variable conducting element 20, 22, 24, 26 is diagrammatically represented. The variable conducting element 20 is supported on dielectric substrate 30 one eighth wavelength above a ground plane 90. The variable conducting element 20 is connected to the ground plane through RF blocks 95.

The variable conducting element 20 is preferably a plasma tube with three electrodes 20A, 20B and 20C; the "T" shape shown is arbitrary and is not intended to be limiting. The presence of at least three electrodes is important, however, as this permits the effective length of the plasma tube to be four different lengths. The lengths are defined by (1) powering no electrodes, or powering electrodes (2) 20A and 20B, (3) 20B and 20C, or (4) 20A and 20C. Thus, when no electrodes are powered, the effective length is zero, when electrodes 20A and 20B are powered it is one-half wavelength long; the element 20 is one-eighth wavelength long when electrodes 20A and 20C are powered; and the plasma tube has an effective length of five-eighths wavelength when electrodes 20B and 20C are powered. The progressive change in element size that can be produced using this variable conductive element 20 will provide a progressive phase shift, which can be used to steer an incident or reflected electromagnetic beam simply by reconfiguring the effective length of the element 20.

Further, although the element 20 in FIG. 10 is described as a plasma tube, it should be understood that an equivalent semiconductor or photonic crystal may be used with the invention for different frequency ranges to produce the same effects.

Resonant waves set up between layers of elements 20 as shown in FIGS. 1A, 2-4 or 10 will cause the reconfiguration in progressive phase shifting to provide reconfigurable beam steering from a horn antenna or similar feed.

Figure 11:
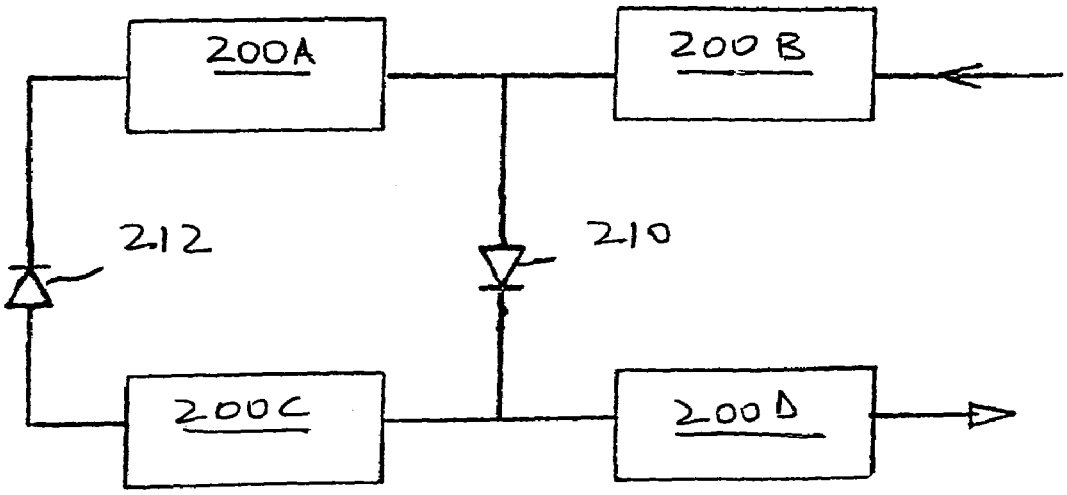
FIG. 11 is a circuit diagram illustrating an alternate reconfigurable length antenna.

FIG. 11 is a circuit diagram for an alternate embodiment of the reconfigurable length plasma elements 20 used with the invention. Four plasma tubes 200A-D are arranged in series with two diodes 210, 212. Diode 210 is connected between plasma tubes 200B and 200D to permit forward current to flow, with plasma tubes 200A, 200C in parallel and shorted out of the forward current circuit. If the current is reversed, then forward diode 210 blocks current flow, while reverse diode 212 connecting plasma tubes 200A and 200C permits current to flow through all four plasma tubes 200A-D.

The reconfigurable length element 20 illustrated in FIG. 11 can be used as the variable conductive element 26 in the array 16 of FIG. 4, for example. The element of FIG. 11 can be reconfigured in length as described to give a progressive reconfigured length, resulting in a progressive phase shift for an array 16, like in FIG. 4, positioned one-eighth wavelength in front of a ground plane, as in FIG. 10. When an incident wave from a feed such as a horn antenna or other antenna sends an electromagnetic signal to the surface of the array 16, a standing wave is formed between the array 16 and ground plane, thereby causing progressive phase shifting in the reflected electromagnetic signal. As above, if the effective lengths of each element 26 are reconfigured, the phase shift is changed accordingly, and the reflected electromagnetic signal can be steered to a particular reflection angle.

Figure 12:
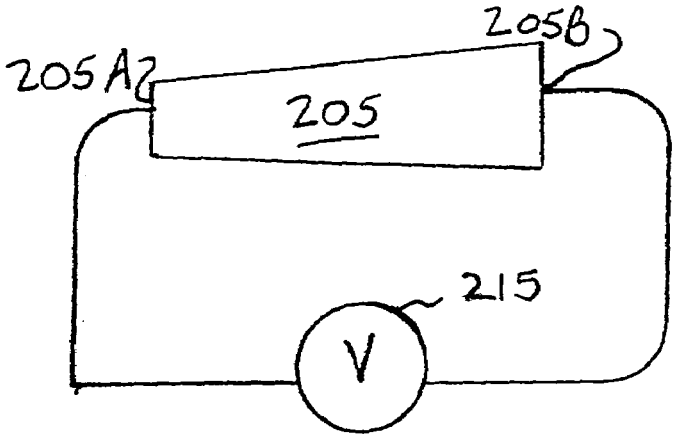
FIG. 12 is a representation of a tapered plasma tube for use with the invention.

FIG. 12 displays yet another plasma tube 205 which can be used as a variable conductive element 20, 22, 24 or 26 of the invention. The plasma tube 205 has a tapered shape, which is wider adjacent electrode 205B than at electrode 205A. The tapered shape causes the conductivity of the plasma tube 205 to vary along its length. Further, as applied voltage source 215 increases, and the current increases, the plasma density in tube 205 also increases.

Figure 13:
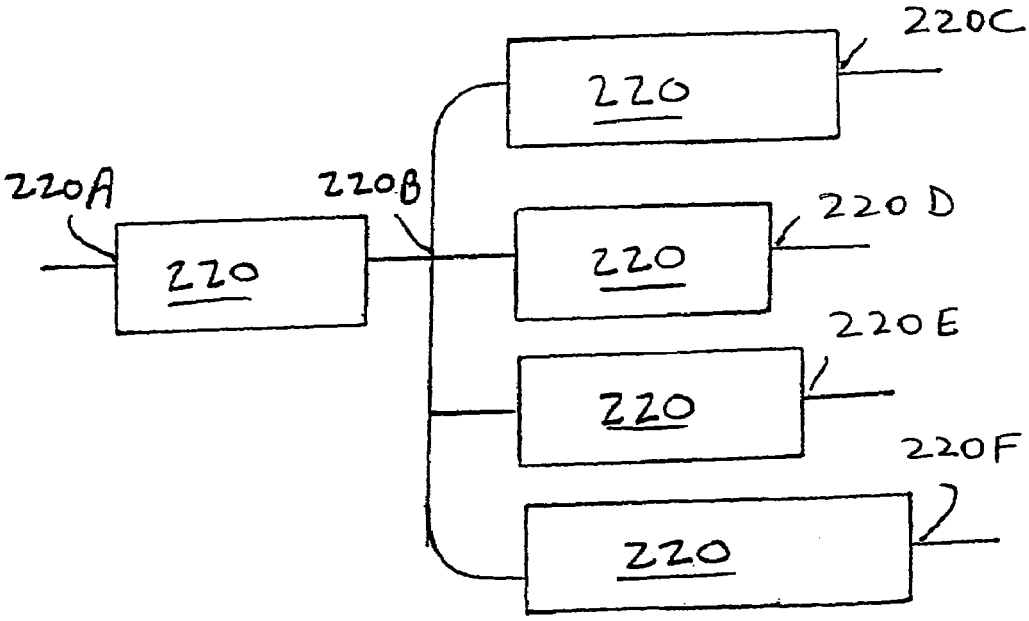
FIG. 13 is a circuit diagram of a reconfigurable length antenna having one plasma tube connected to four additional plasma tubes.

FIG. 13 shows a circuit diagram for a further reconfigurable length element 20, 22, 24 or 26. Plasma tubes 225 of varying lengths are connected to electrode 220B of primary plasma tube 220. Electrode 220A is connected to a power source (not shown). Electrodes 220C-F are switchably connected to the power source. By selecting a different one of the electrodes 220C-F, a different length plasma tube 225 is powered and the effective length of the element 20, 22, 24, 26 is changed. Preferably, the plasma tubes 220, 225 are all positioned within one wavelength apart, and more preferably within one-half wavelength apart.

In a further configuration of the plasma tubes 220, 225 of FIG. 13, primary plasma tube 220 may be constantly driven by current flowing from electrode 220A to 220B. Primary plasma tube 220 is made reflective and provides one effective length, so that particular frequencies of transmitted signal are affected. Additional plasma tubes 225 are energized between electrode 220B and electrodes 220C-F, to increase their plasma density sufficiently to become reflective, thereby reconfiguring the effective length of the element 20,2 22, 24, 26.

As should be apparent, either power configuration of the plasma tubes 220, 225 in FIG. 13 will result in a reconfigurable length variable conductive element 20, 22, 24, 26. Thus, a wide range of frequencies can be affected using arrays 10, 12, 14, 16 with these reconfigurable variable conductive elements 20, 22, 24, 26, and rapid switching between frequencies is made possible by use of plasma tubes.

Figure 14:
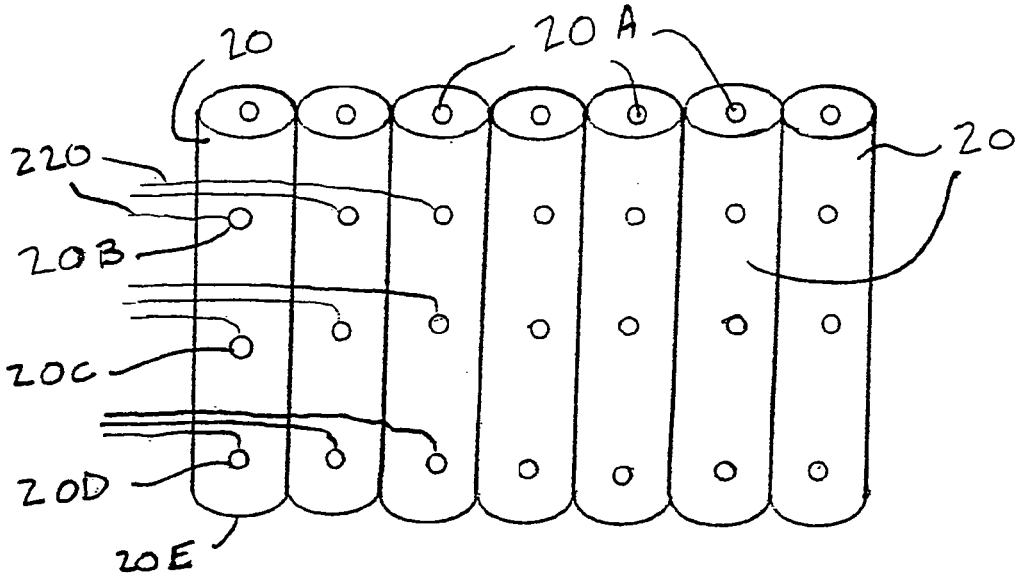
FIG. 14 is an schematic diagram of an array of electrodes connected to a series of plasma tubes along their lengths.

Turning now to FIG. 14, a planar array of plasma tube variable conductive elements 20 each have several electrodes 20A-D along their length, and at their bottom ends (not shown). The electrodes 20A-D can be connected to power sources via thin wires 230. Electrodes 20A-D and wires 230 are both much smaller than the incident wavelengths of electromagnetic signals reaching the array. It is also possible to power the plasma tube elements 20 by remote excitation using electromagnetic energy at frequencies outside the ranges being affected by the array.

The different electrodes 20A-D and bottom electrodes may be powered to ionize and form plasma along different lengths of each plasma tube element 20. Powering different plasma tube elements 20 and at different lengths creates different combinations of slots and reflective surfaces, so that the array can be configured for reflecting, transmitting or steering of different frequencies of incident electromagnetic signals.

Figure 15:
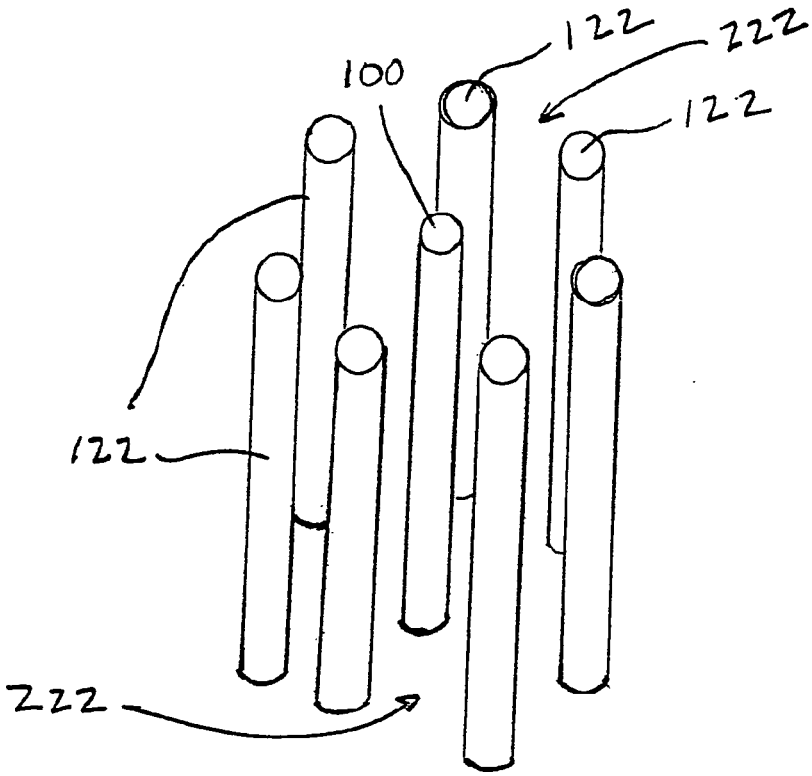
FIG. 15 is a diagram illustrating a steerable antenna of the invention having a plasma annular ring composed of several plasma tubes surrounding an antenna.

FIG. 15 illustrates a steerable antenna 110 of the invention similar to those of FIGS. 5B and 5F. As seen in FIG. 15, omnidirectional antenna 100 is surrounded by several plasma tubes 122 with gaps 222 between them. Omnidirectional antenna 100 may be a plasma tube as well, or it may be a conventional metal dipole, or, preferably, a biconical antenna for transmitting a broad frequency range.

When the plasma tubes 122 are powered to sufficiently high plasma density that the frequency exceeds the transmission frequencies, the size of the gaps 222 between the tubes 122 and distance from the omnidirectional antenna 100 determine the extent of signal reflection caused by the plasma tubes 122. The calculations for making such determination are discussed in detail above. When spaced properly and powered sufficiently, plasma tubes 122 produce a perfectly reflective shield 120 that prevents electromagnetic signals from omnidirectional antenna 100 from escaping and transmitting.

As the plasma density, and therefore, the frequency, are decreased, in a particular plasma tube 122, that tube becomes transparent for electromagnetic signals generated by the omnidirectional antenna 100. Thus, if a single plasma tube is powered down so as to be transparent to a particular frequency or all frequencies, an electromagnetic signal transmitting from omnidirectional antenna 100 will be permitted to escape or broadcast along the radials passing through the aperture formed by the transparent plasma tube 122 and any adjacent gaps 222. The antenna signal can be steered by simply opening and closing apertures by powering and unpowering the plasma tubes 122. The amount of radiation released will depend in part upon the distance of the plasma tube ring from the antenna 100 times the wavenumber of the antenna radiation.

A multi-frequency steerable antenna can be created by adding further rings of plasma tubes 122 spaced apart and at radial distances from antenna 100 to optimally affect particular frequencies. An antenna of this configuration permits selectively transmitting specific frequencies along specific radials.

In a further modification, the reflective shield can include annular tubes (not shown) stacked perpendicular around the plasma tubes 122, to provide additional control over the size of aperture created. When specific annular tubes are unpowered in combination with certain plasma tubes 122, a transmission window through the reflective shield is formed along a particular radial and at a particular elevation. Thus, steering in the vertical direction can be combined with radial steering.

Further, the powered plasma tubes in any cylinder may act as a parabolic reflector for the affected frequencies, thereby strengthening the transmitted signal through an aperture. Similarly, the plasma densities can be adjusted to produce plasma lenses for focusing the transmitted antenna signal beam.

Preferably, the apertures will be at least one wavelength in arc length to permit effective transmission. It should be noted that Fabry-Perot Etalon effects may occur for the release of electromagnetic radiation through the antenna while powering the plasma tubes 122, but at lower plasma densities than for signal reflection.

Figure 16:
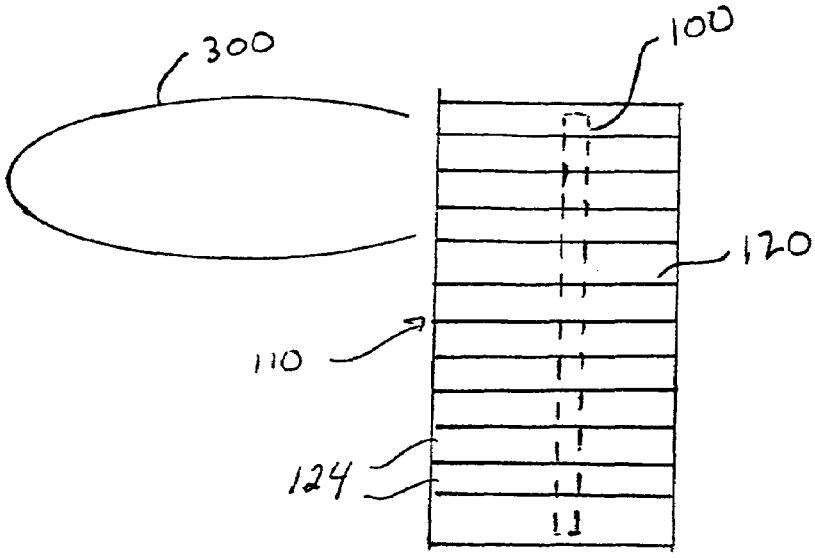
FIG. 16 is a diagram illustrating the radiation pattern of a steerable antenna of the invention.
Figure 17:
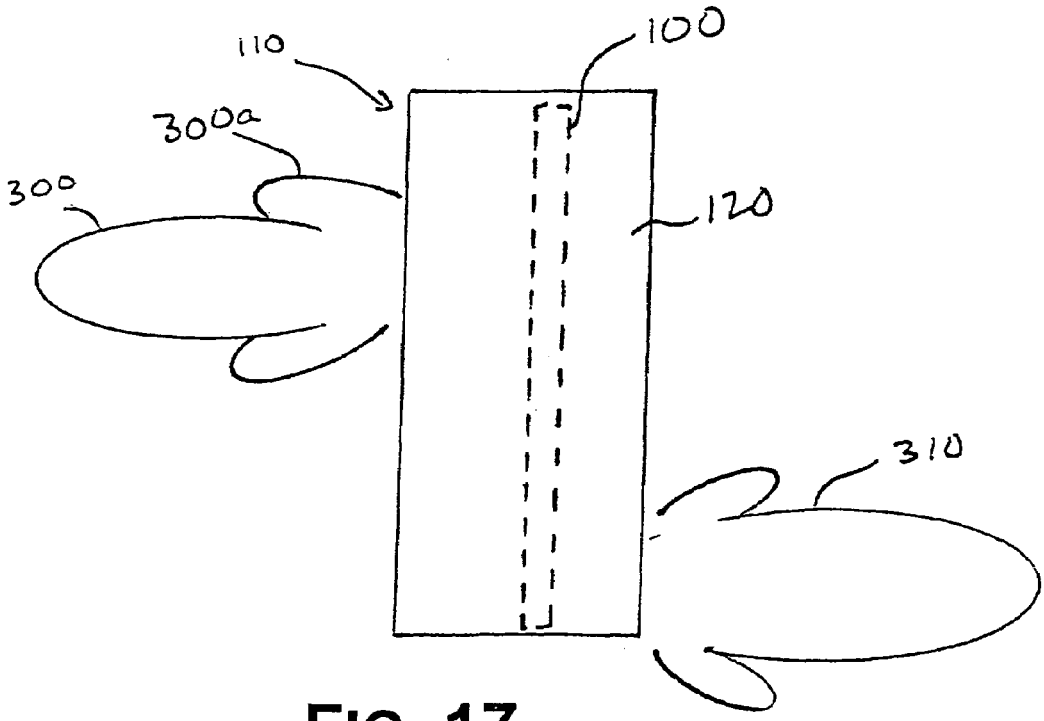
FIG. 17 is a diagram illustrating the radiation pattern for a differently configured steerable antenna of the invention.

FIGS. 16 and 17 illustrate transmission radiation lobes which can be produced using the antenna 110 of the invention. FIG. 16 shows how the reflective shield 120 can include a layer of annular plasma tubes 124 oriented perpendicular to vertical shield elements. Thus, in FIG. 16, a transmission radiation lobe 300 is produced along a particular radial and at an elevation selected by unpowering the upper ones of the annular plasma tubes 124.

Similarly, in FIG. 17, two different transmission radiation lobes 300, 310 are produced by creating apertures on each side of antenna 110 and at different elevations. The transmission radiation lobes 300 illustrated have side lobes 300*a*.

Figure 18:
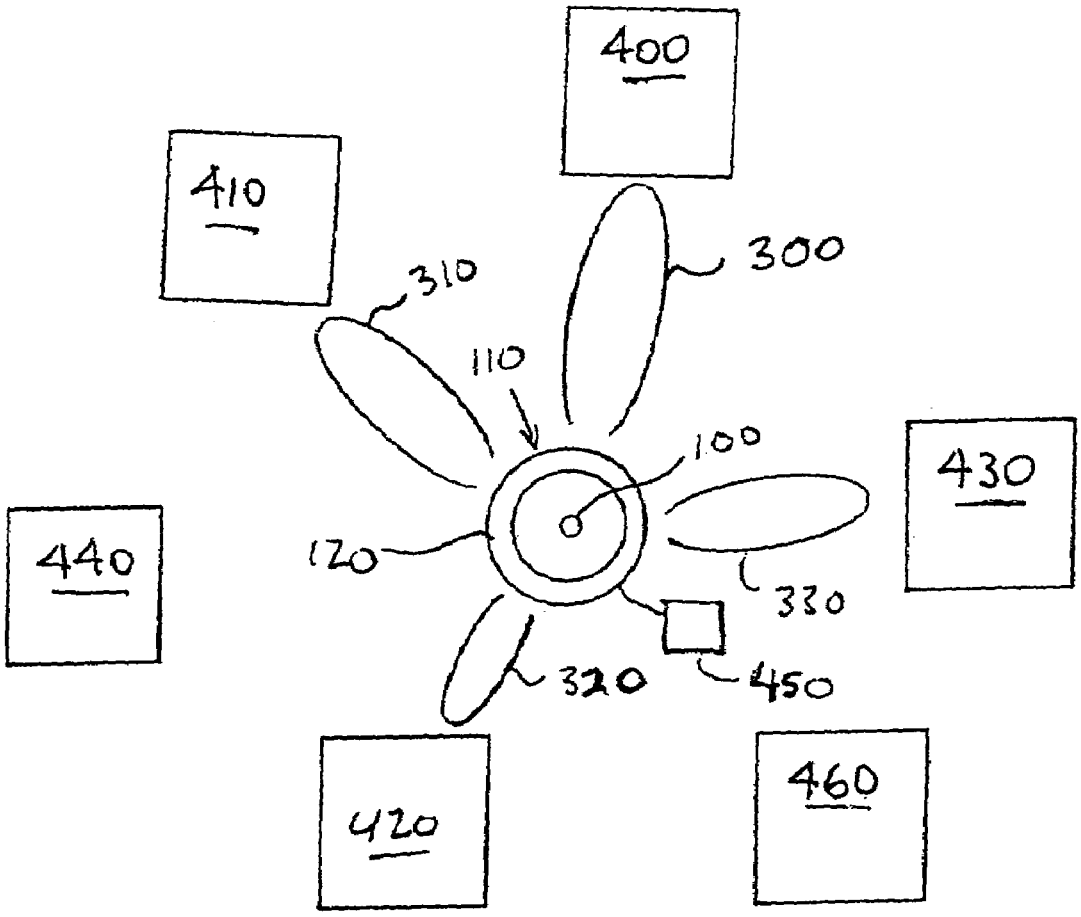
FIG. 18 is a diagram showing radiation patterns for a steerable antenna of the invention used for wireless communication between computers.
Figure 19:
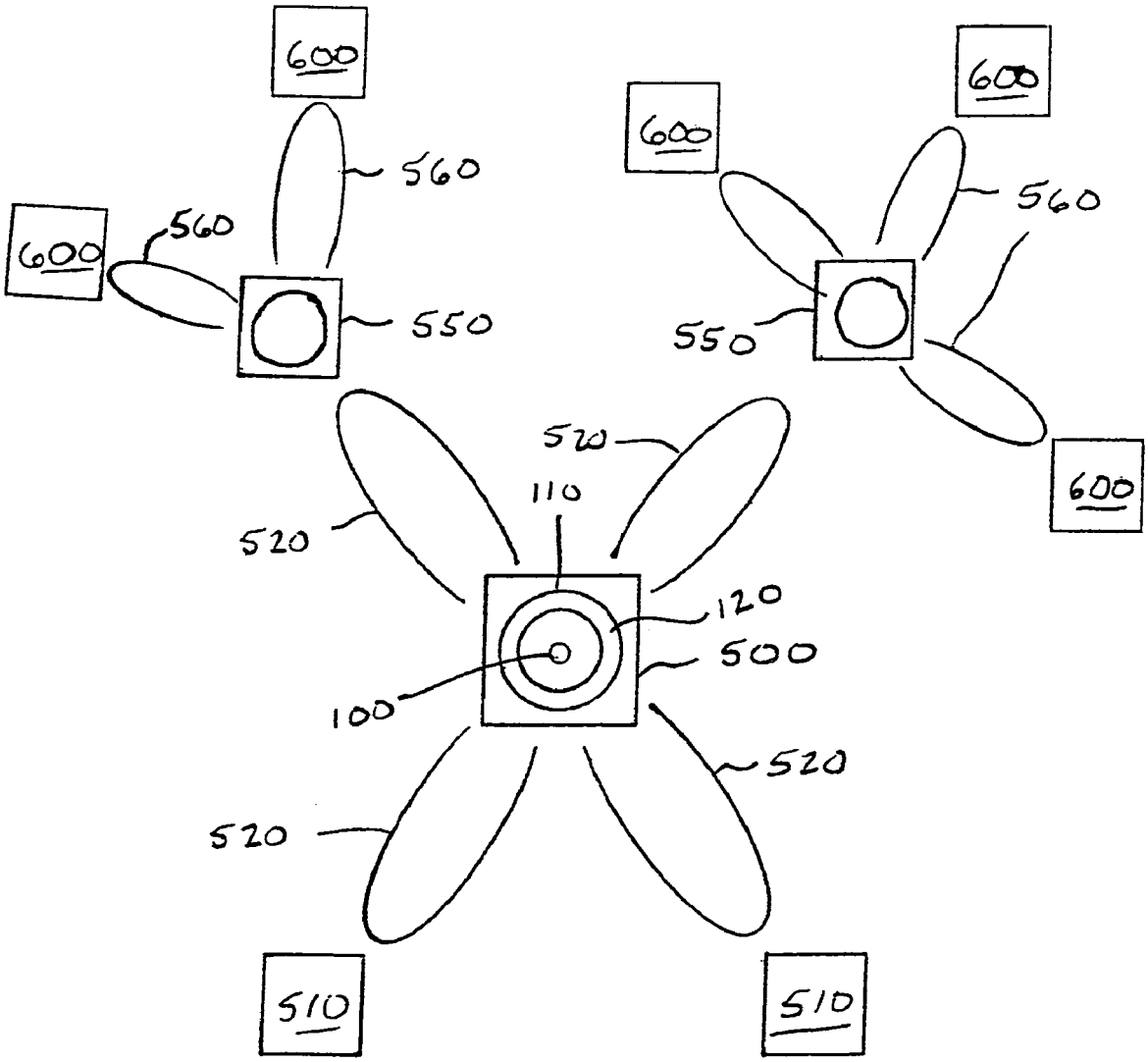
FIG. 19 is a diagram showing radiation patterns for a steerable antenna of the invention used in an alternate wireless communication configuration.

In FIGS. 18 and 19, two possible network communications systems are displayed.

FIG. 18 shows a first system in a which a central master steerable antenna 110 is connected to a transceiver 450 for transmitting and receiving wireless electromagnetic signals. Steerable antenna 110 is composed of reflective shield 120 surrounding antenna 100. Antenna 100 may be a metal dipole, biconical antenna or a plasma antenna. The reflective shield 120 is formed from an annular ring of plasma elements, or one or more arrays 10, 12, 14, 16 for selectively creating transmission apertures through the shield 120.

The antenna 110 is configured to transmit and receive through apertures along selected radials. Radiation lobes 300, 310, 320, 330 transmitting through apertures in shield 120 are directed at known locations of remote stations 400, 410, 420, 430, respectively. Unauthorized users 460 are positioned around antenna 110 as well, but they do not receive any transmissions from antenna 110 due to shield 120 being configured to block or internally reflect the transmission signals in those directions. The remote stations 400, 410, 420, 430 may securely communicate with the transceiver at the master antenna 110 via wireless communications along the specific radiation lobes 300, 310, 320, 330 generated by the antenna 110.

The remote stations 400, 410, 420, 430 can have omnidirectional antennas 100 only or they may have steerable antennas 110. If remote stations 400, 410, 420, 430 have steerable antennas 110 connected to their transceivers as well, those antennas can be configured to transmit only along the radial connecting the respective remote stations to the master antenna. In such case, the only way for an unauthorized user 460 to intercept the communication is to position themselves on one of the communication lobe 300, 310, 320, 330 radials. When using an omnidirectional antenna 100 alone, unauthorized users 460 may receive half of the communications; that is, the portion transmitted by the remote stations.

One application of this communications system is for corporate networking systems, in which the master antenna 110 can be set to permit transmissions, and thus, connections, only to network stations along set radials. For example, remote station 410 may correspond to a single workstation or a workgroup within an office building; transmission lobe 310 is generated within the appropriate radials to communication with remote station 410. But, a second workstation or workgroup 460, such as a user in another department or an unauthorized user, such as a corporate spy located outside the office building, can be denied a connection by the shield 120 blocking transmission along all other radials. Since most omnidirectional antennas 100 produce radiation patterns resembling donuts around the antenna 100 in the absence of reflective arrays, or a shield 120 according to the invention, users above and below the master antenna 110 should not be able to access the network either.

In an alternate embodiment, remote stations 400, 410, 420, 430 can correspond to members of a military squad, and master antenna 110 and transceiver are with the squad leader. Unauthorized users 460 are enemy soldiers. It is envisioned that the squad members 400, 410, 420, 430 can move relative to the squad leader and master antenna 110 and computer controllers can be used to maintain transmission lobes 300, 310, 320, 330 directed at the squad members 400, 410, 420, 430. In such case, the squad members 400, 410, 420, 430 will also have steerable antennas for securely transmitting back to the master antenna 110. The squad members can acquire an initial signal by using the steerable antenna as an omnidirectional antenna to find the master antenna signal, and then subsequently powering the reflective shield to limit transmission along the necessary radial. Meanwhile, enemy soldiers 460 will not be able to monitor squad transmissions, unless they happen to become located along one of the transmission lobe radials 300, 310, 320, 330. Such communications provides the added security that the transmissions are not easily intercepted to decode, nor can they be used to easily triangulate the position of the squad members.

FIG. 19 shows another wireless transmission network having levels of communications, such as for a wireless network service provider. A primary steerable antenna 110 is connected to a server computer 500 and the antenna 110 is set to transmit radiation lobes 520 at selected radials. Network computers 510 receive and transmit signals along lobes 520. Network computers 510 can be backbone computers or other computers used to establish a large scale network, connected by landlines and other means to other network computers.

Substation computers 550 have steerable antennas 110 as well for selectively transmitting to network user computers 600 along user communications lobe radials 560.

Using the network system of FIG. 19, a wireless network can be created for residential areas in which only subscribing users have access to the network, but which is rapidly configurable to permit the addition or removal of users accessing the system. For example, a server computer 500 can be located centrally in a populated area and positioned for easily connecting to network computers 510. Several substation computers 550 can be placed throughout the community, such as mounted on top of lightposts, telephone poles, existing towers, etc. Then, as residents 600 indicate a desire to connect to the network, transmission lobes 560 from local substation computers 550 are opened.

And, similarly to the network of FIG. 18, the network can be configured for use with controllers to permit mobile users to roam within an area covered by substation computers 550 and remain connected by steering the transmission lobe 560 and switching between different substation computers 550.

The networks of FIGS. 18 and 19 are advantageous over known wireless networks because they provide some network security without encryption, and have reconfigurable bandwidths and beam widths. As a result, among other things, greater amounts of useful data can be transferred more rapidly between computers or other communications devices on the network than current wireless network systems.

It should be noted that in all of the applications discussed above, plasma-containing elements used as plasma antennas or passive plasma elements can be operated in the continuous mode or pulsed mode. During the pulse mode, the plasma antenna or passive plasma elements can operate during the pulse, or after the pulse in the after-glow mode. To reduce plasma noise, the plasma can be pulsed in consecutive amplitudes of equal and opposite sign. Phase noise can be reduced by determining whether the phase variations are random or discrete and using digital signal processing. Phase noise, thermal noise, and shot noise in the plasma can also be reduced by digital signal processing.

Photonic Crystal Based Fine Beam Steering Device

As noted above, the steerable antennas and arrays of variable conductive elements are adaptable to incorporate photonic crystal based systems for use with signals in the optical range. One application within the scope of this invention is using fine steering mirrors (FSM) capable of greater than 5 kHz bandwidth with submicroradian pointing accuracy in a power efficient design by tuning the effective index of refraction in a photonic crystal.

The use of photonic crystals as the variable conductive elements 20 in the arrays of FIGS. 1A and 2-4 addresses the need for improved fine-steering mirrors for free-space optical communications systems. That is, the photonic crystals provide a similar effect in the optical wavelength ranges.

A fine-steering system based on the use of an electrically tunable photonic crystal provides a small, light-weight, low-cost, alternative to conventional systems with considerably reduce power consumption. Sub-microradian steering accuracy is achieved by capitalizing on the fact that photonic crystals can be designed to have sensitive dependence of the beam steering effect in response to small changes in external parameters such as an applied field. The following description details the enabling physical phenomena, as well as the practical engineering steps, which are needed to produce a superior fine-steering system.

Beam steering can be done by tuning the effective refractive index in a photonic crystal. The photonic crystal design is a low power and compact device with accurate and rapid beam steering. Beam steering with photonic crystals with laser gryroscopes and feedback and controls greatly reduces jitter from platform vibration from mechanical steering of mirrors. The development of fine beam steering with photonic crystals is amenable to use and combination with other advances in nanotechnology.

Wide-angle beam steering in a photonic crystal is achieved for a range of frequencies by tuning the photonic band structure via the application of electric and magnetic fields. In this section we focus on the question of how to steer the beam through altering the effective index of refraction. The details of how to achieve the desired value of the effective refractive index through tuning the photonic band structure are discussed further below.

The beam steering effect is conceptually very simple and hinges on the fact that for certain frequencies, the propagation can be described in terms of familiar concepts of refractive optics. In general, the propagation of light in a photonic crystal is extremely complex and cannot be understood in terms of conventional diffractive or refractive optics concepts. However, for a range of frequencies near the photonic band gap(s) the behavior becomes simplified and can be explained in terms of an effective index of refraction. Thus, given the effective indices of refraction for the incident medium and the photonic crystal, $n_1$, and $n_2$, respectively, the propagation angle in the photonic crystal $\theta_2$, is determined in terms of the indices of refraction and the incident angle $\theta_1$, by the well-known Snell's law of geometric optics:

$$n_1 \sin(\theta_1)=n_2 \sin(\theta_2).$$

The crucial enabling difference between light propagating in a photonic crystal and that for an ordinary dielectric is that the effective index of refraction in the photonic crystal can become arbitrarily small, and is typically negative. In contrast, the dielectric constant in an ordinary dielectric material (not near a resonance) is restricted to positive values and has a magnitude greater than unity. The anomalous behavior of the effective index for a photonic crystal is due to strong multiple scattering and occurs only in strongly modulated photonic crystals. That is, those crystals with a large contrast in the indices of the constituent dielectrics.

Beam Steering Effect

Figure 20:
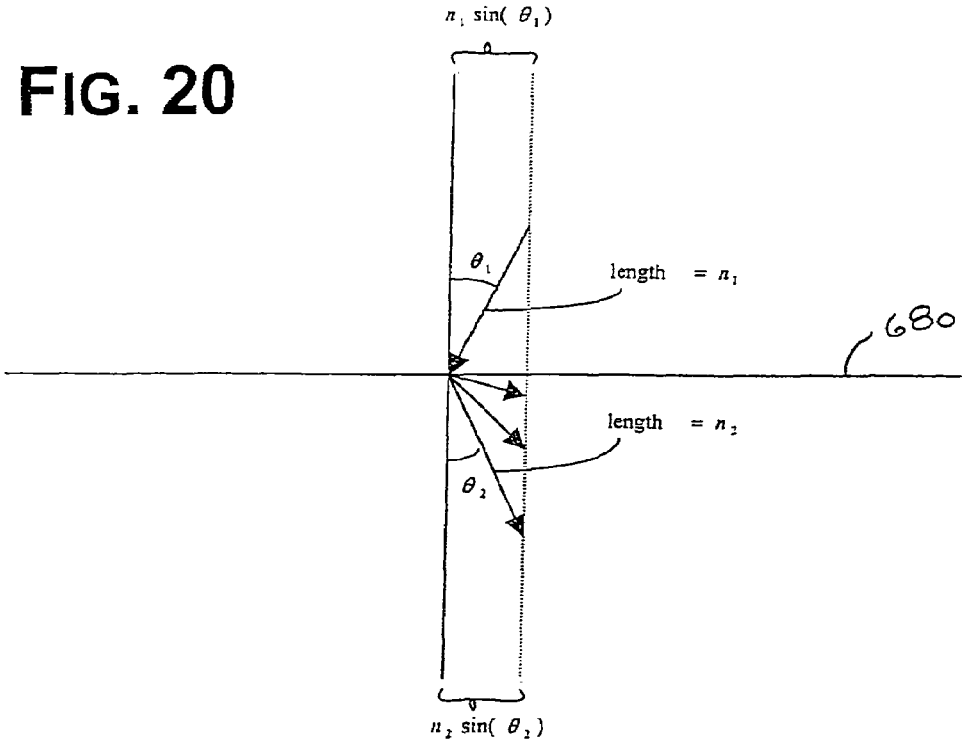
FIG. 20 is a graph demonstrating the beam steering effect as a solution of. Snell's law in a photonic crystal.

The beam steering effect is illustrated in FIG. 20 for the situation in which the index of refraction is negative in the photonic crystal. Negative index of refraction results in the refracted angle having the opposite sign as for an ordinary dielectric. To simplify the notation, the refracted wave direction is redefined as indicated in FIG. 20, and all angles and indices are considered to be positive.

For a fixed value of $n_1 \sin(\theta_1)$, $\theta_2$ varies as $n_2$ is varied so as to satisfy Snell's law as illustrated. Because the index $n_2$ can be made arbitrarily small, the refracted angle can be as large as $\theta_2=\pi/2$. In this case, Snell's law takes the form $n_1$ $\sin(\theta_1)=n_2$. For values of $n_2<n_1 \sin(\theta_1)$, there is no solution and the incident wave is completely reflected (i.e. a photonic band gap occurs).

FIG. 20 illustrates the beam steering effect as the solution of Snell's law for a negative refraction index in the photonic crystal. The horizontal line corresponds to the interface 680 between the incident medium (medium 1) and the photonic crystal (medium 2). For a fixed value of the incident angle ($\theta_1$), measured with respect to the surface normal, and index of refraction ($n_1$), the refraction angle ($\theta_2$), varies with the value of the index of refraction in the photonic crystal ($n_2$).

As discussed, for simplicity, we have redefined the direction of the refracted angle so that all angles and indices can be regarded as positive in FIG. 20. A large variation in refraction angle can be obtained because of the fact that the index in the photonic crystal can become very small.

Although, the index $n_2$ can be made arbitrarily small, its maximum magnitude is limited to be on the order of unity ($|n_2|\approx 1.0-1.5$). Thus for a fixed value of $n_1 \sin(\theta_1)$, the smallest value of $\theta_2$ is obtained for the largest value of $n_2$. That is: $\sin(\theta_{2,min})=n_1 \sin(\theta_1)/n_{2,max}$. For the largest sweep of the steering, $\theta^{2,min}\leqq\theta\leqq\pi/2$, therefore, $n_1 \sin(\theta_1)$, is made very small, but non-zero. In other words, the interesting situation occurs where the largest beam steering effect occurs for the smallest non-zero value of $n_1 \sin(\theta_1)$, while at the same time no beam steering occurs at all if $n_1 \sin(\theta_1)\equiv 0$, exactly.

Clearly, the pathological behavior described in the previous paragraph is forbidden in an ordinary dielectric for which the minimum dielectric constant has a fixed finite value (e.g. $n_2\approx 1$). In that case, both the minimum and maximum diffracted angle $\theta_2$ is constrained to approach zero as $n_1 \sin(\theta_1)\rightarrow 0$. We see that for near normal incidence (i.e. $n_1 \sin(\theta_1)\rightarrow 0$), the propagation direction in the photonic crystal $\theta_2$ becomes extremely sensitive to the value of the of the effective index in the photonic crystal $n_2$ This behavior will be studied in detail using realistic Finite Difference Time Domain electromagnetic simulations in order to obtain suitable parameters for a practical device.

Steerable Photonic Crystal Antenna Geometry

The overall geometry of the beam-steering device is crucial to obtaining a practical device. It is shown above that large-angle beam steering can be achieved through the use of a photonic crystal for frequencies near a band gap. We now wish to consider the question of how this light will behave after exiting the photonic crystal.

No net beam steering can occur if the incident and exit faces of the device are parallel. This is a well-established fact of optics related to time-reversal symmetry which also applies to photonic crystals. In essence the diffraction which occurs upon entering the crystal through one face is un-done as the light exits the other parallel face. This is why traditional prisms are triangular. The same situation has been discussed in the closely-related area of photonic crystal superprism applications.

Figure 21:
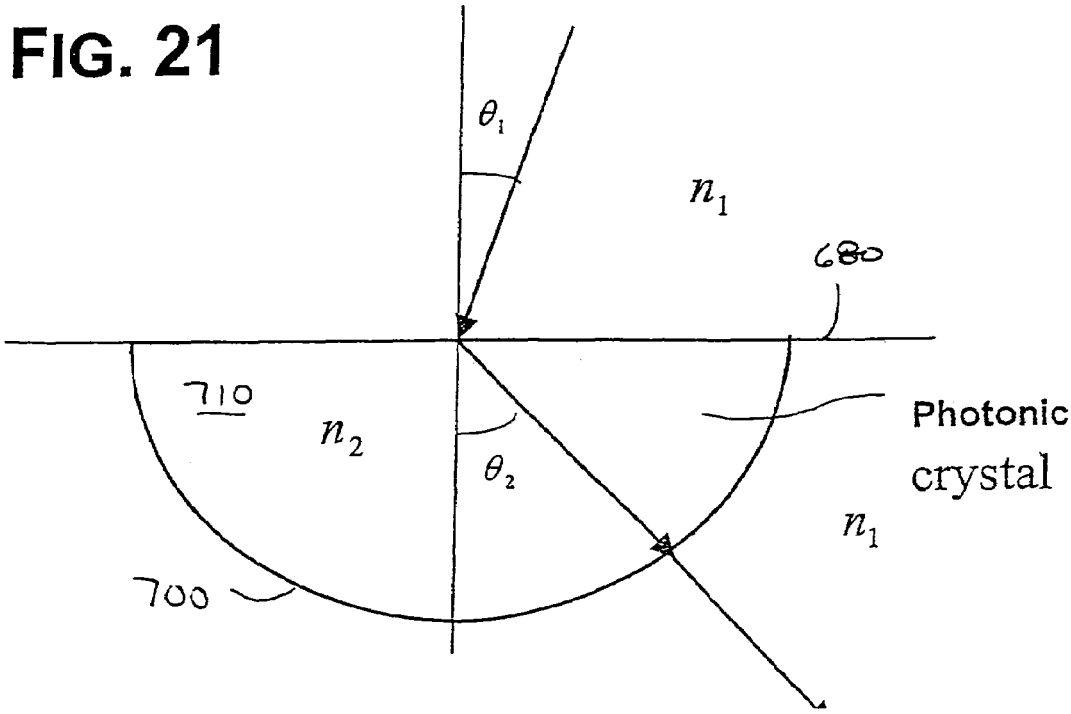
FIG. 21 is a diagram of the geometry of a photonic crystal-based beam steering device showing a cross section of a right semi-circular cylinder.

The geometry we choose is a right semi-circular cylinder as illustrated in FIG. 21. A cross section of the right semi-circular cylinder viewed along the symmetry axis is shown. Explicitly we imagine starting with a right circular cylinder aligned with the z-axis, which is perpendicular to the page. The x-, and y-axes are aligned with the horizontal and vertical lines of the figure respectively. The structure 710 in the figure is obtained by cutting a right circular cylinder in half by slicing along the x-z plane containing the z-axis.

In the geometry illustrated, the refracted wave in the photonic crystal exits the structure 710 in a direction normal to the exciting surface 700 and as such, suffers no further refraction. The structure 710 is assumed to extend a finite distance L, out of the plane so as to form a three dimensional structure. The beam is assumed to be of a fixed frequency and it can be steered by altering the properties of the photonic crystal.

Photonic Band Structure and Anomalous Light Propagation

The beam steering application discussed in this invention hinges on two important properties of photonic crystals. These properties are: (1) anomalous light propagation, such as the superprism effect, and, (2) the ability to tune the photonic band structure, within the spectrum of allowable states, through the application of external fields or mechanical strains.

The propagation of light in a photonic crystal is determined by the photonic band structure, that is, the spectrum of allowable propagating states for a given wave vector composed of a direction and wave length. The functional relationship between the frequency and momentum of a photon is called the dispersion relation and has the following form $\omega=ck$, in free space, where $\omega=2\pi f$ is the angular frequency, c is the speed of light in vacuum, and $k=2\pi/\lambda$, is the wave number, and $f$, and $\lambda$ are the frequency and wavelength of light.

In a photonic crystal, the dispersion relation is considerably more complicated due to multiple scattering effects. The allowable wave numbers are restricted to a finite range ($-\pi/\alpha\leqq k\leqq\pi/\alpha$, for a one-dimensional crystal of spacing $\alpha$, for example), and the $\omega$ vs. k relation becomes a disconnected family of curves (bands) along a given direction. Examples are given in most of the references cited so far.

The propagation velocity is given by $\vec{v}=\nabla_k\omega_n(\vec{k})$, where we have written the dispersion relation in its most general form $\omega=\omega_n(\vec{k})$, emphasizing the fact that the frequency for a given band n is a function of the direction as well as magnitude of the wave vector $\vec{k}$.

For a fixed value of the frequency, $\omega_0$, the dispersion relation $\omega_0=\omega_n(\vec{k})$ is an equation for a surface in three-dimensional $\vec{k}$-space. Such a surface in the context of electrons in solids is called the Fermi Surface. In photonic crystals, this surface is often called the equi-frequency surface (EFS). For light propagation in free space the EFS is a sphere and the velocity is parallel to the vector $\vec{k}$. In general, however, the EFS in a photonic crystal is not spherical and the velocity is not parallel to the wave-vector. The study of the how the anomalous propagation behavior in photonic crystals arises out of details of the EFS is explored in detail in Ref.

The superprism effect arises due to particular features in the EFS such as cusps and rounded corners of the EFS. As the frequency or incident angle is changed by a small amount, the direction of the propagation angle can change dramatically.

Instead of changing the frequency for a given photonic band structure, similar dramatic effects can occur for a fixed frequency upon changing the photonic band structure with applied fields as is discussed in detail in Ref. This fact is the enabling physical phenomena, which underlies the beam steering application discussed in the present proposal.

While a specific embodiment of the invention has been shown and described in detail to illustrate the application of the principles of the invention, it will be understood that the invention may be embodied otherwise without departing from such principles.

What is claimed is:

1. A configurable multiband, far-field antenna for broadcasting or receiving an electromagnetic wireless signal comprising:

at least two arrays of variable conductive elements arranged in a spaced apart stack of array layers, each array having at least a pair of switchable, powered, variable conductive elements selected from the group consisting of plasma-containing elements, semiconductor elements and photonic bandgap crystals and each array being arranged at a distance from the antenna and each array being operative to selectively define a desired direction in which the antenna receives or transmits the electromagnetic wireless signal;

wherein the variable conductive elements are not operative to interpret the electromagnetic wireless signal, and wherein the variable conductive elements of each array are shaped as one of dipoles, circular dipoles, helicals, circular or square or other spirals, biconicals, hexagons, tripods, Jerusalem crosses, plus-sign crosses, annular rings, gang buster type antennas, tripole elements, anchor elements, star or spoked elements, alpha elements, gamma elements, and combinations thereof.

2. The configurable multiband antenna of claim 1, wherein the variable conductive elements are formed as non-conductive shaped slots surrounded by a corresponding shaped region of variable conductive material.

3. The configurable multiband antenna of claim 1, wherein, in each array, the variable conductive elements are oriented co-planar.

4. The configurable multiband antenna of claim 1, wherein, in each array, the variable conductive elements are oriented on the perimeter of a closed volumetric shape.

5. The configurable multiband antenna of claim 1, wherein the two arrays are selectively configured to at least one of filter, polarize, propagate, steer, deflect at non-backscattering angles, and phase shift the electromagnetic signal along selected radials.

6. A configurable multiband, far-field antenna for broadcasting or receiving an electromagnetic wireless signal comprising:

at least two arrays of variable conductive elements arranged in a spaced apart stack of array layers, each array having at least a pair of switchable, powered, variable conductive elements selected from the group consisting of plasma-containing elements, semiconductor elements and photonic bandgap crystals and each array being arranged at a distance from the antenna;

wherein the variable conductive elements are not operative to interpret the electromagnetic wireless signal, and wherein the at least two arrays are selectively configured to at least one of filter, polarize, propagate, steer, deflect at non-backscattering angles, and phase shift the electromagnetic wireless signal along selected radials.

7. The configurable multiband antenna of claim 6, wherein the variable conductive elements of each array are shaped as one of dipoles, circular dipoles, helicals, circular or square or other spirals, biconicals, hexagons, tripods, Jerusalem crosses, plus-sign crosses, annular rings, gang buster type antennas, tripole elements, anchor elements, star or spoked elements, alpha elements, gamma elements, and combinations thereof.

8. The configurable multiband antenna of claim 6, wherein the distance is equal to or more than one wavelength of the electromagnetic wireless signal.

9. A configurable multiband, far-field antenna for broadcasting or receiving an electromagnetic wireless signal comprising:

at least one array of variable conductive elements having at least a pair of switchable, powered, variable conductive elements selected from the group consisting of plasma-containing elements, semiconductor elements and photonic bandgap crystals, the array being arranged at a distance from the antenna;

wherein the variable conductive elements are not operative to interpret the electromagnetic wireless signal, and wherein the at least one array is selectively configured to at least one of filter, polarize, propagate, steer, deflect at non-backscattering angles, and phase shift the electromagnetic wireless signal along selected radials.

10. The configurable multiband antenna of claim 9, wherein the variable conductive elements of the array are shaped as one of dipoles, circular dipoles, helicals, circular or square or other spirals, biconicals, hexagons, tripods, Jerusalem crosses, plus-sign crosses, annular rings, gang buster type antennas, tripole elements, anchor elements, star or spoked elements, alpha elements, gamma elements, and combinations thereof.

11. The configurable multiband antenna of claim 9, wherein the distance is equal to or more than one wavelength of the electromagnetic wireless signal.

* * * * *